US006753466B1

(12) United States Patent
Lee

(10) Patent No.: US 6,753,466 B1
(45) Date of Patent: Jun. 22, 2004

(54) ELECTRONIC PROGRAMMABLE SYSTEM FOR PLAYING STRINGED INSTRUMENTS AND METHOD OF USING SAME

(76) Inventor: Day Sun Lee, 1145 Pacific Ave. Apt. 17, Long Beach, CA (US) 90731

( * ) Notice: Subject to any disclaimer, the term of this patent is extended or adjusted under 35 U.S.C. 154(b) by 639 days.

(21) Appl. No.: 10/260,040

(22) Filed: Oct. 16, 2000

Related U.S. Application Data

(63) Continuation-in-part of application No. 09/382,145, filed on Aug. 24, 1999, now abandoned.

(51) Int. Cl.[7] ..... G10H 5/00

(52) U.S. Cl. ..... 84/669; 84/470 R; 84/471 R; 84/477 R; 84/478; 84/479

(58) Field of Search ..... 84/470 R, 471 R, 84/477 R, 478, 479

(56) References Cited

U.S. PATENT DOCUMENTS 3,758,698 A * 9/1973 Matyas ..... 84/485 R
4,412,473 A * 11/1983 Laflamme ..... 84/485 R
4,545,282 A * 10/1985 Arnett et al. ..... 84/317
4,622,880 A * 11/1986 Glemming et al. ..... 84/317
5,557,057 A * 9/1996 Starr ..... 84/617
5,639,977 A * 6/1997 Hesnan ..... 84/477 R
5,831,189 A * 11/1998 Edlund ..... 84/315

* cited by examiner

*Primary Examiner*—Jeffrey Donels
(74) *Attorney, Agent, or Firm*—George T. Parsons

(57) ABSTRACT

An electronic programmable system including a membrane switch chordboard with a printed chord arrangement affixed to the chordboard. A chord arrangement is written for each different stringed instrument. The chordboard also has a plurality of <olenoids provided for each stringed instrument. These solenoids act as pressers for each instrument string. As each membrane on the outer surface of the chordboard is pressed, an electronic circuit is closed activating a solenoid driver. The programmable system then retrieves programmed notes or chords from a software module's look-up table. Next, the system activates a solenoid plunger. This plunger then presses against a string. The player then strums or picks the strings. A player can maintain the sound of a chord by maintaining finger pressure on the preferred membrane. A software program is written for each type of stringed instrument. This program in concert with the solenoids expands the sound range of any string instrument beyond the limitation of the human hand's thumb to first finger reach.

44 Claims, 20 Drawing Sheets

Microfiche Appendix Included
(1 Microfiche, 24 Pages)

300
SYSTEM START
305
INITIALIZE SYSTEM
310
SELF-TEST SYSTEM
315
CALL CHORDBOARD SCAN () FUNCTION
320
ARE "M" & "7" CHORDS PRESSED ?
YES
325
CALL SELF_ DEFINE () FUNCTION
NO
330
IS THE OUTPUT KEEPING MODE ON ?
NO
YES
360
ARE CHORDS PRESSED ?
NO
YES
335
ARE CHORDS PRESSED ?
NO
YES
370
CALL OUT_DISP () DRIVER TO CLEAR THE OUTPUT

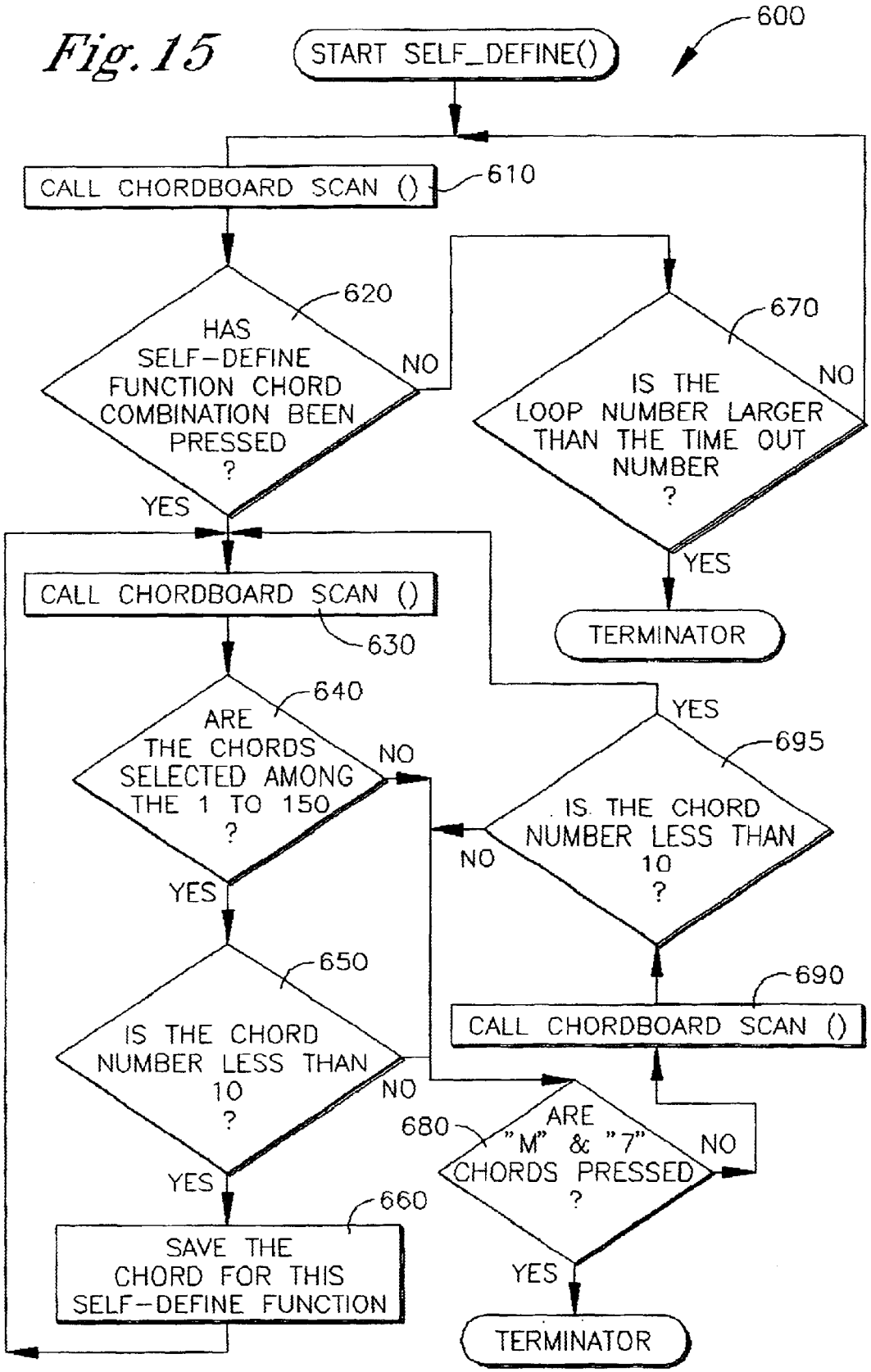
Fig. 15
START SELF_DEFINE()
600
CALL CHORDBOARD SCAN ()
610
HAS SELF-DEFINE FUNCTION CHORD COMBINATION BEEN PRESSED ?
620
NO
YES
IS THE LOOP NUMBER LARGER THAN THE TIME OUT NUMBER ?
670
NO
YES
TERMINATOR
CALL CHORDBOARD SCAN ()
630
ARE THE CHORDS SELECTED AMONG THE 1 TO 150 ?
640
NO
YES
IS THE CHORD NUMBER LESS THAN 10 ?
650
NO
YES
SAVE THE CHORD FOR THIS SELF-DEFINE FUNCTION
660
YES
695
NO
CALL CHORDBOARD SCAN ()
690
ARE "M" & "7" CHORDS PRESSED ?
680
NO
YES
TERMINATOR

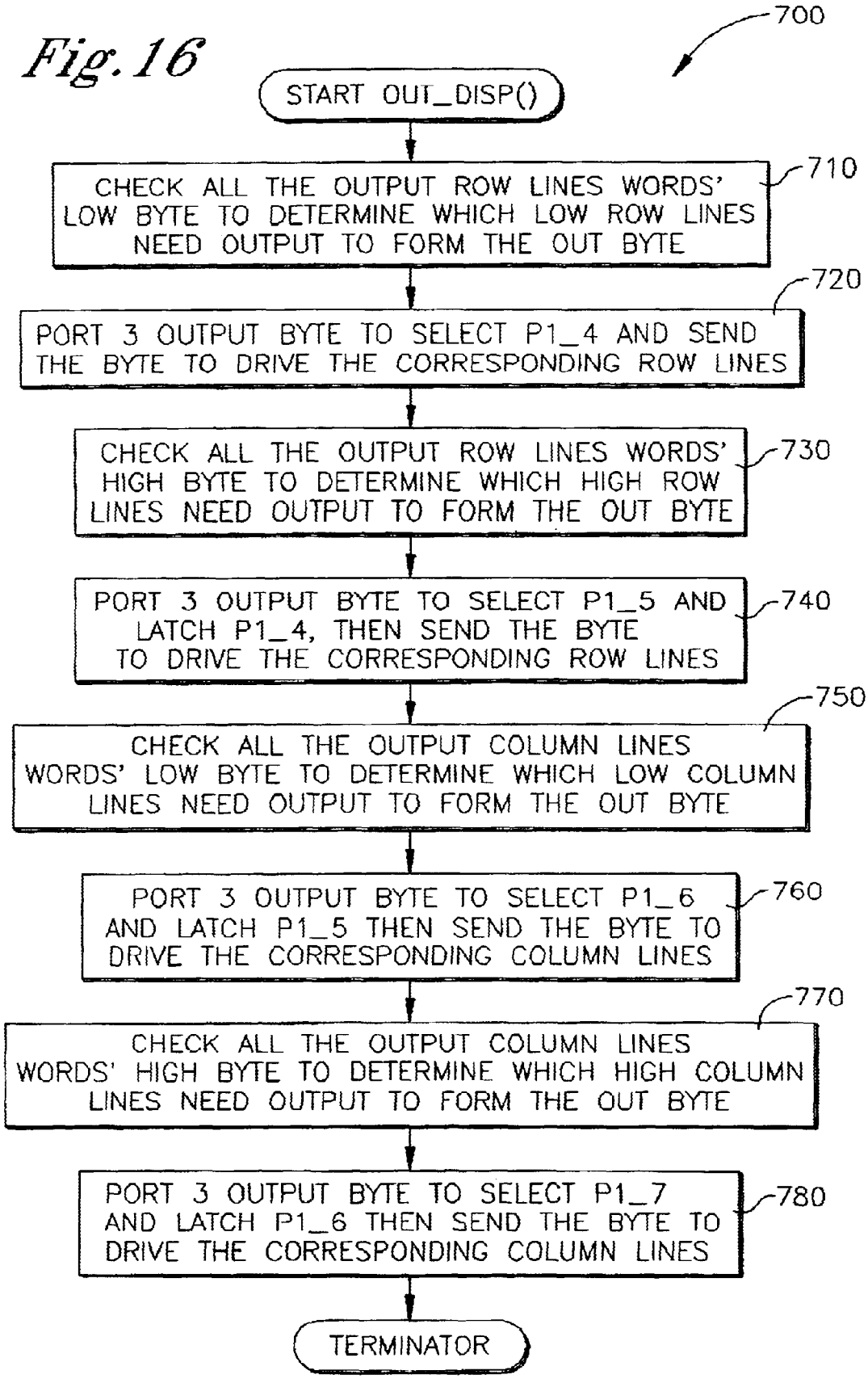
Fig. 16
700
START OUT_DISP()
CHECK ALL THE OUTPUT ROW LINES WORDS' LOW BYTE TO DETERMINE WHICH LOW ROW LINES NEED OUTPUT TO FORM THE OUT BYTE
710
PORT 3 OUTPUT BYTE TO SELECT P1_4 AND SEND THE BYTE TO DRIVE THE CORRESPONDING ROW LINES
720
CHECK ALL THE OUTPUT ROW LINES WORDS' HIGH BYTE TO DETERMINE WHICH HIGH ROW LINES NEED OUTPUT TO FORM THE OUT BYTE
730
PORT 3 OUTPUT BYTE TO SELECT P1_5 AND LATCH P1_4, THEN SEND THE BYTE TO DRIVE THE CORRESPONDING ROW LINES
740
CHECK ALL THE OUTPUT COLUMN LINES WORDS' LOW BYTE TO DETERMINE WHICH LOW COLUMN LINES NEED OUTPUT TO FORM THE OUT BYTE
750
PORT 3 OUTPUT BYTE TO SELECT P1_6 AND LATCH P1_5 THEN SEND THE BYTE TO DRIVE THE CORRESPONDING COLUMN LINES
760
CHECK ALL THE OUTPUT COLUMN LINES WORDS' HIGH BYTE TO DETERMINE WHICH HIGH COLUMN LINES NEED OUTPUT TO FORM THE OUT BYTE
770
PORT 3 OUTPUT BYTE TO SELECT P1_7 AND LATCH P1_6 THEN SEND THE BYTE TO DRIVE THE CORRESPONDING COLUMN LINES
780
TERMINATOR

ELECTRONIC PROGRAMMABLE SYSTEM FOR PLAYING STRINGED INSTRUMENTS AND METHOD OF USING SAME

RELATED APPLICATION

The present application is a continuation-in-part of co-pending application U.S. Ser. No. 09/382,145 filed Aug. 24, 1999, now abandoned entitled "A Miracle Chordboard and A Miracle Guitar".

Microfiche Appendix

A microfiche appendix containing computer source code is attached. The microfiche appendix comprises one sheet of microfiche having 24 frames. The microfiche appendix contains material which is subject to copyright protection. The copyright owner has no objection to the reproduction of such material, as it appears in the files of the Patent and Trademark Office, but otherwise reserves all copyright rights whatsoever.

BACKGROUND OF THE INVENTION

1. Field of the Invention

The present invention relates generally to musical instruments and more particularly to an electronic programmable system for playing stringed instruments.

2. Description of the Related Art

The stringed instrument field includes the six string guitar, bass guitar, banjo, mandolin, auto harp, and others.
Because of the difficulty for people to learn to play these instruments, numerous devices have been invented to assist the player. Just a few of these include chord learning aids, braille matrices to help the visually impaired to learn to play instruments, and button systems to dampen sounds or to press certain chords. Despite these various devices, most are directed towards learning to play the instrument. Very few are designed to facilitate the actually playing by one who already knows how to play. One known device, attached over the finger board, uses a very limited number of mechanical buttons in a complex mechanical apparatus. Each button can be pressed manually for a pre-selected chord or string.

Known prior art requires the player to use several fingers to play a chord. In addition, the player must move his hands and fingers to different fret positions to play virtually any song. The hand and arm used for playing the frets often must be in awkward positions, straining the muscles of the hand and fingers. Also, those people with smaller than average hands are unable to play some songs because of the chords required. Obviously, a player must also memorize the string positions at the different frets.

Therefore, it is clear that a need exists for an improved stringed instrument playing system which overcomes long-standing problems to playing. The Applicant thinks the present invention overcomes many long-standing and even ignored problems and disadvantages of the prior art. A new system which only requires one or two fingers to play, eliminates the need to move hands and fingers along a fret board, prevents straining of hand and finger muscles, and allows any player to play any song, regardless of the size of their hands would be major and novel improvements in this field. In addition, the present invention expands the sound range of any string instrument. The present invention is also capable of pressing any chord, including chords that cannot be played with an unaided human hand. Also the present invention enables a player to strum all strings for any chord.

Plus, a player can add desired chords to the system memory; and can even ad lib against a simultaneously held note.

Prior art in the stringed instrument field includes the following U.S. Patents: Matyas, U.S. Pat. No. 3,758,698, Fretted Instrument Fingerboard Chord Slide Rule; Hesnan, U.S. Pat. No. 5,639,977, "Music Learning Aid"; Glemming, et al. U.S. Pat. No. 4,622,880, "Chording Apparatus for Stringed Musical Instrument"; and Arnett, et al., U.S. Pat. No. 4,545,282, "Chord Selector Device for Stringed Musical Instruments".

Matyas, U.S. Pat. No. 3,758,698, Fretted Instrument Fingerboard Chord Slide Rule discloses a slide rule for a fretted musical instrument having a plurality of differently tuned strings. This invention is directed towards axially movable slide members to convert a musical chord into a visual fingering pattern directly related to the frets of the instrument. Matyas teaches the use of a longitudinally arranged chordboard that includes the use of rods. Disadvantages to this device include being directed more towards one learning to play an instrument. Other disadvantages include the need to use the traditional fingering technique of three or four fingers, and moving the fingers and hands to different fret positions, thereby possibly straining the muscles of the hand and fingers. Another disadvantage is that people with smaller than average hands are still unable to play some songs because of the chords required. Matyas does not expand the sound range of any string instrument. Matyas does not disclose an electronic programmable system. Matyas also does not enables a player to strum all strings for any chord.

Hesnan, U.S. Pat. No. 5,639,977, "Music Learning Aid" discloses a music learning aid. This invention is directed towards a device which will make it easier for a person to learn how to play an instrument. One embodiment includes a programmable display function so that a learner sees notes and instructions for learning. Disadvantages to this design include being directed more towards one learning to play an instrument. It does not help make the act of playing itself any easier.

Glemming, et al. U.S. Pat. No. 4,622,880, "Chording Apparatus for Stringed Musical Instrument" discloses a chording apparatus. This invention is directed towards a plurality of chord selecting buttons and a plurality of string depressing hammers. Disadvantages to this design include the use of many mechanical buttons and hammers. Despite the disclosing of an " . . . arrangement of buttons, actuating arms, and hammers . . . for the selection of a maximum number of chord combinations with a minimum number of parts." (Column 2, lines 9–12), the device still uses a complex mechanical apparatus with a variety of movements and pressures. The present invention uses a simpler electro-mechanical system. In addition, the number of possible mechanical buttons appears limited, thereby limiting the number of chords available for playing to about 14. In the present invention, hundreds of chords and chord combinations are possible. Glemming does not disclose an electronic programmable system. Glemming does not expand the sound range of any string instrument. More specifically, the present invention provides for all major and minor chords, including D major and E major chords, through a programmed look-up table. Glemming also does not enable a player to strum all strings for any chord.

Arnett, et al., U.S. Pat. No. 4,545,282, "Chord Selector Device for Stringed Musical Instruments" discloses a chord former. This invention is directed towards the use of a chord selector and playing device used for pressing a plurality of strings. Arnett also teaches the use of longitudinally arranged string pressers that press multiple strings. Disadvantages to this design include the use of a mechanism with many parts all of which must work in concert to properly play the selected chord. The number of buttons on the device are necessarily limited by the disclosed invention. Arnett does not expand the sound range of any string instrument. Arnett also does not enables a player to strum all strings for any chord. Arnett does not disclose an electronic programmable system.

Finally, it is clear that the present invention is quite different from an auto harp which has twenty-one manual chord buttons. One major disadvantage to an auto harp is that an auto harp uses a pedal which dampens some of the strings, allowing only a few strings to be sounded. On the other hand, the present invention does not employ a pedal system, yet allows all strings to be strummed for any chord. Another disadvantage is that the single string of the auto harp can produce only a single tone.

In summary, all the cited patents have a multitude of disadvantages. As is quickly realized, most of the patents disclose attempts to improve the way a person learns to play a stringed instrument. Some attempt to improve the playing technique using mechanical buttons. However, problems still exist with these attempts. In addition, some remarkable improvements in the present invention have never been envisioned in the prior art. Therefore, it is an object of the present invention to provide a novel membrane switch chordboard. Another object is to provide a unique chord arrangement applicable to various stringed instruments. Still another object is to provide an electronic system using easily-activated solenoids to act as pressers for each instrument string. Still another object of the present invention is to provide a novel chords software program to greatly facilitate the playing of many stringed instruments. Furthermore, it is an object of the invention to provide the means for expanding the sound range of any string instrument. Additionally, it is an object to enable a player to strum all strings for any chord. Finally, it is an object to provide a method of playing a stringed instrument using an electronic programmable system.

SUMMARY OF THE INVENTION

The above-mentioned difficulties and problems of the prior art are overcome by the present invention. Briefly stated, the present invention provides novel improvements to playing many stringed instruments. In summary, the present invention represents an electronic programmable system having many unique features. More specifically, the present invention comprises a chordboard, an electronic control unit, and a stringed instrument. Another way of describing the programmable system is that it comprises an input unit; the chordboard, a control unit; the electronic control unit; and an output unit, the stringed instrument.

One feature is a novel membrane switch chordboard. The chordboard may have a plurality of embodiments. One preferred embodiment is for the chordboard to be located above a portion of the neck of a typical stringed instrument in an appropriately sized package. Another preferred embodiment is for the chordboard to be located underneath the neck of the instrument in an appropriately sized package. An associated feature of the chordboard is a unique chord arrangement affixed to the chordboard. A unique chord arrangement can be written for each different stringed instrument, including but not limited to such stringed instruments as a banjo, cello, or bass guitar. For example, as seen in the microfiche appendix, 477 chords are programmable into the present invention for a novel 10 string guitar. In addition, 272 chords are programmable for a banjo. For a mandolin, 255 chords are programmable; and 120 chords are programmable for a base guitar. The chords for other stringed instruments may also be programmed for the present invention.

The chordboard also has a plurality of solenoids uniquely provided for each stringed instrument. These easily-activated solenoids include plungers which act as pressers for each instrument string. For example, if a guitar has fifteen frets, then fifteen solenoids times the number of strings would be used to press strings. The number of solenoids can be designed for any instrument, not just guitars.

More specifically, as each membrane switch on the outer surface of the chordboard is gently pressed, the novel control unit is activated. Next, an electronic circuit is closed activating a solenoid driver, which in turn activates a solenoid plunger. This plunger then is moved a slight approximately vertical distance to press against a string. The distance moved is on the order of ⅛th inch. Then a player can either strum or pick a chord or note. As soon as the membrane on the chordboard is released, the sound stops. However, if the player desires to hold the note or chord, the player can keep the electronic circuit closed to the desired chord merely by maintaining slight finger pressure on the preferred membrane. This feature, of being able to maintain the sound of a note or chord, is considered unique in musical instruments. It is also unique in being able to use only slight finger pressure to select the desired chords or notes. In the current art, greater pressure is needed to press and hold down any mechanical buttons.

Still another novel feature of the present invention is a chords software program written for each type of stringed instrument. No longer does one need to learn different fingering techniques for different instruments. Furthermore, with this chords program, the sound range of any string instrument is expanded beyond the limitation of the human hand's thumb to first finger reach. Harmonies and melodies can be written and programmed for instruments that currently do not have such music because of the previous need to play with a finger technique. Therefore, a player can strum all strings for any chord, with either the right hand or the left.

These, and other features and advantages of the present invention are set forth more completely in the accompanying drawings and the following description.

BRIEF DESCRIPTION OF THE DRAWINGS

Details of the invention, and of the preferred embodiment thereof, will be further understood upon reference to the drawings, wherein closely related elements have the same number but different alphabetical suffixes, and further wherein:

FIG. 15 is a flow chart of a self-define function module for the control system, according to the present invention; and FIG. 16 is a flow chart of an output module for the control system, according to the present invention.

DETAILED DESCRIPTION OF THE PREFERRED EMBODIMENTS

Figure 1A:
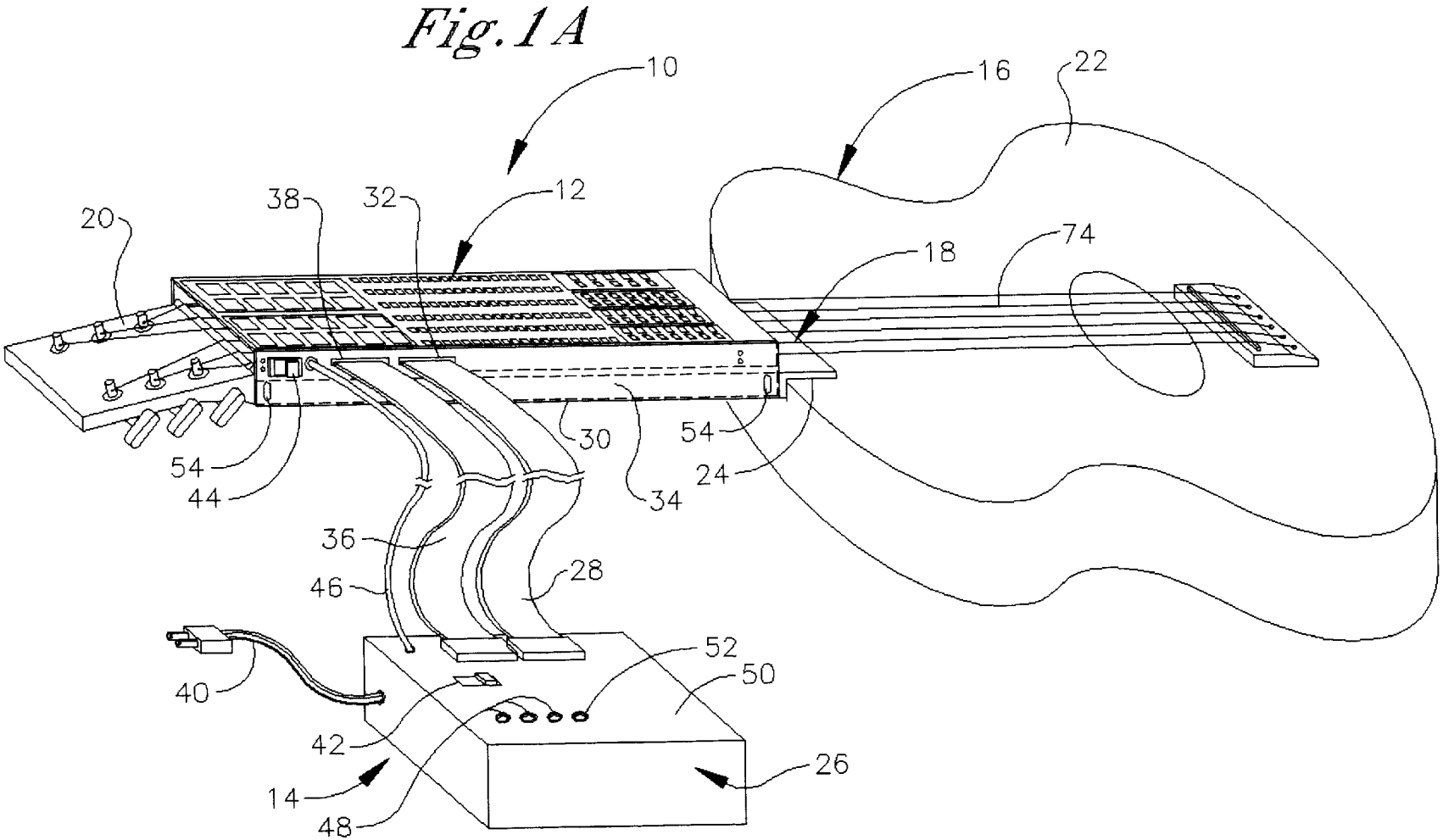
FIG. 1A is a perspective representation of the present invention showing a typical six-string guitar with a chordboard above the guitar strings and a control unit.

Referring initially to FIG. 1, an exploded partial perspective representation of an electronic programmable system for playing stringed instruments 10 is shown. More conveniently called the programmable system 10 for descriptive purposes, it comprises a chordboard 12, an electronic control system or unit 14, and a stringed instrument 16. Another way of describing the system 10 is that it comprises an input unit; the chordboard 12, a control unit, the electronic control system 14; and an output unit, the stringed instrument 16. The stringed instrument 16 is represented by a modified six string guitar in FIG. 1. The instrument 16 may be either electric or acoustic. The chordboard 12 is securely affixed to the stringed instrument 16 using a plurality of easily purchased screws.

More specifically, the chordboard 12 is secured over a modified fretboard 18 between a neck 20 and a sound box 22. In other words, modifications to a typical six string guitar would include replacing its existing fretboard with the modified fretboard 18 between the neck 20 and the sound box 22. The chordboard 12 may be of at least two lengths and locations between the neck 20 and the sound box 22. More specifically, the chordboard 12 may be as shown in FIG. 1, extending longitudinally between the neck 20 and the sound box 22. In another embodiment, the chordboard 12 may be shorter and, therefore, extend only part way from the neck 20 toward the sound box 22. The embodiment with the shorter chordboard 12 is shown in FIG. 11B and described more completely later in this detailed description. Regarding at least two locations, the chordboard 12 may be as shown located over the modified fretboard 18. In another embodiment, the chordboard is located underneath the stringed instrument 16, and extending from the neck 20 to the sound box 22.

An extended metallic lip 24 on the fretboard 18 is distally located from the neck 18. The lip 24 is secured to the sound box 22 with an appropriate glue. In addition, the fretboard 18 is secured to the sound box 22 with appropriate screws. The fretboard 18 is preferably metallic, such as aluminum or steel. It also is hollow inside. In a first embodiment, the control unit 14 is in a separate control box 26 electronically connected to the chordboard 12 through an appropriate header ribbon cable 28. In a second embodiment, shown and described in FIG. 3A, the control unit 14 is securely affixed to an underside 30 of the fretboard 18.

Continuing with FIG. 1A, the control unit 14 is further electrically connected to the chordboard 12 . More specifically, the header ribbon cable 28 is connected to the chordboard 12 through a first cutout 32 in a vertical side 34 of the chordboard 12. In addition, a solenoid ribbon cable 36 is electrically connected from the control system 14 to the chordboard 12 through a second cutout 38. A power cord 40 connects the control system 14 to an AC source. To more conveniently turn on the programmable system 10, an on/off switch 42 is preferably located on a side of the control box 26. In one embodiment of the control system 14, the control box 26 is located in close proximity to the stringed instrument 16.

In a second embodiment, the control system 14 is located at such a distance from the stringed instrument 16 that a secondary on/off switch 44 is desirable and is located on the vertical side 34 of the chordboard 12. Therefore, a player can merely turn on and off the programmable system 10 using the secondary on/off switch 4 4, instead of reaching or walking to the control box 26 to press the on/off switch 42. The "on" position provides D.C. power to the chordboard 12. The power from the control box 26 to the secondary switch 44 is through an on/off switch wire 46.

The ribbon cables 28, 36 are connected to the control box 26 by one of a variety of options for routing. One such preferred routing is for the ribbon cables 28, 36, and the switch wire 46 from the secondary on/off switch 44 to be bundled together underneath the neck 20 of the stringed instrument 16, then laid in a channel (not shown) cut into the underside 30 of the stringed instrument 16, with the bundle leading under the sound box 22 and ultimately to the control box 26.

Also shown on the control box 26 is a plurality of indicator lights. More specifically, preferably three LED warning lights 48 are located preferably on a top surface 50 of the control box 26. In addition, an indicator LED light 52 is located on the box top surface 50. These LED lights 48, 52 are discussed more fully in the description of FIG. 2.

Finally, note that the chordboard 12 is fixedly secured to the stringed instrument 16 through a plurality of slotted holes 54 in the vertical sides 34 of the chordboard 12.

Figure 1B:
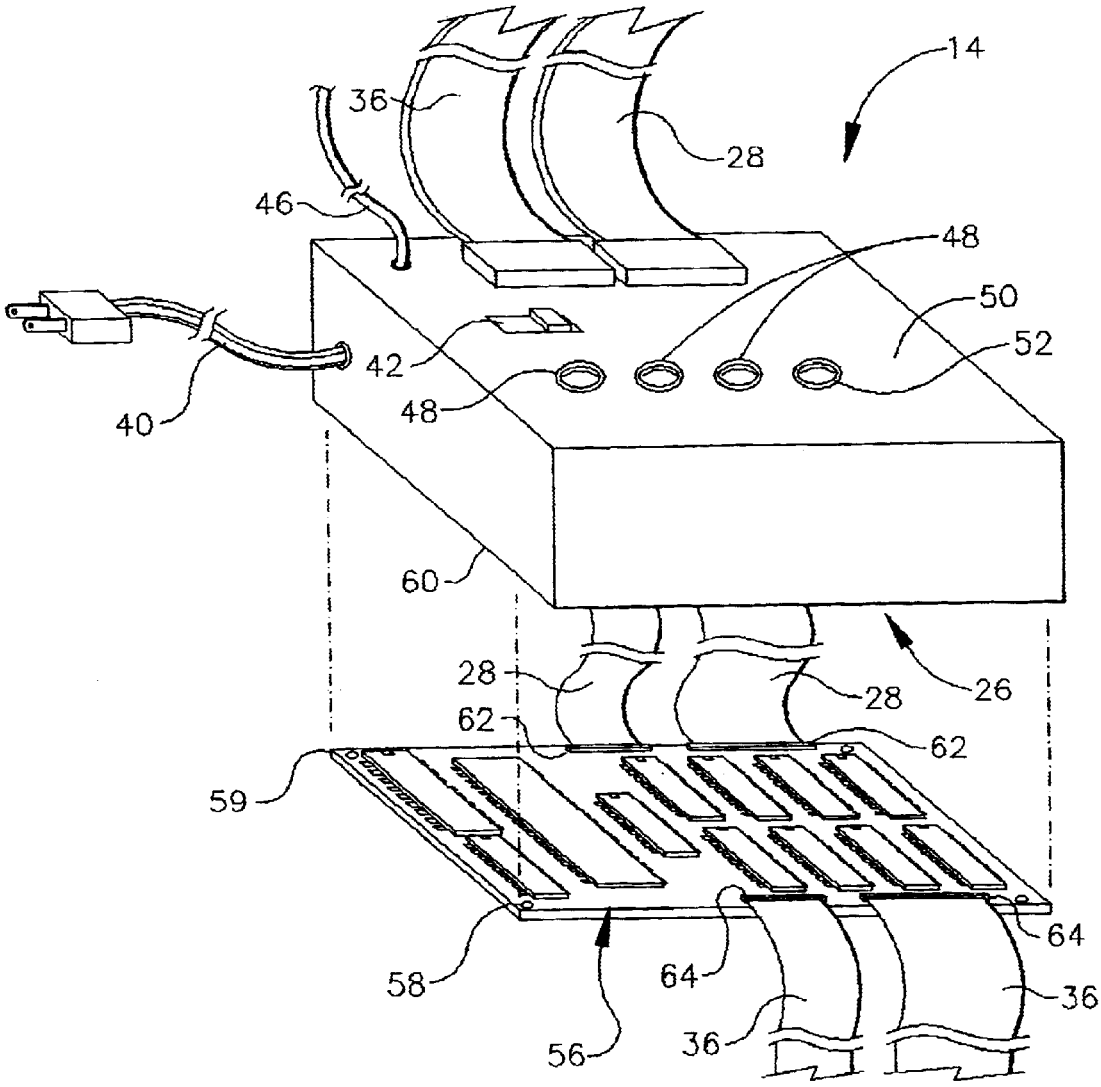
FIG. 1B is an enlarged partial perspective representation of the control unit with its control board.

Next referring to FIG. 1B , an enlarged partial perspective representation of the control unit 14 in the control box 26. Also shown is a control board 56 within the control box 26. The control board 56 is fixedly secured within the control box 26 preferably using a plurality of screws (not shown) through a plurality of securing holes 58 in the control board 56. Preferably, the securing holes 58 are located proximate to each corner 59 of the control board 56. More specifically, the control board 56 is secured to the underside 60 of the control box 26.

A plurality of headers are located on the control board 56. Preferably, two row and column headers 62 are located on one part of the control board 56, while preferably two solenoid headers 64 are located on another part of the control board 56.

Figure 2:
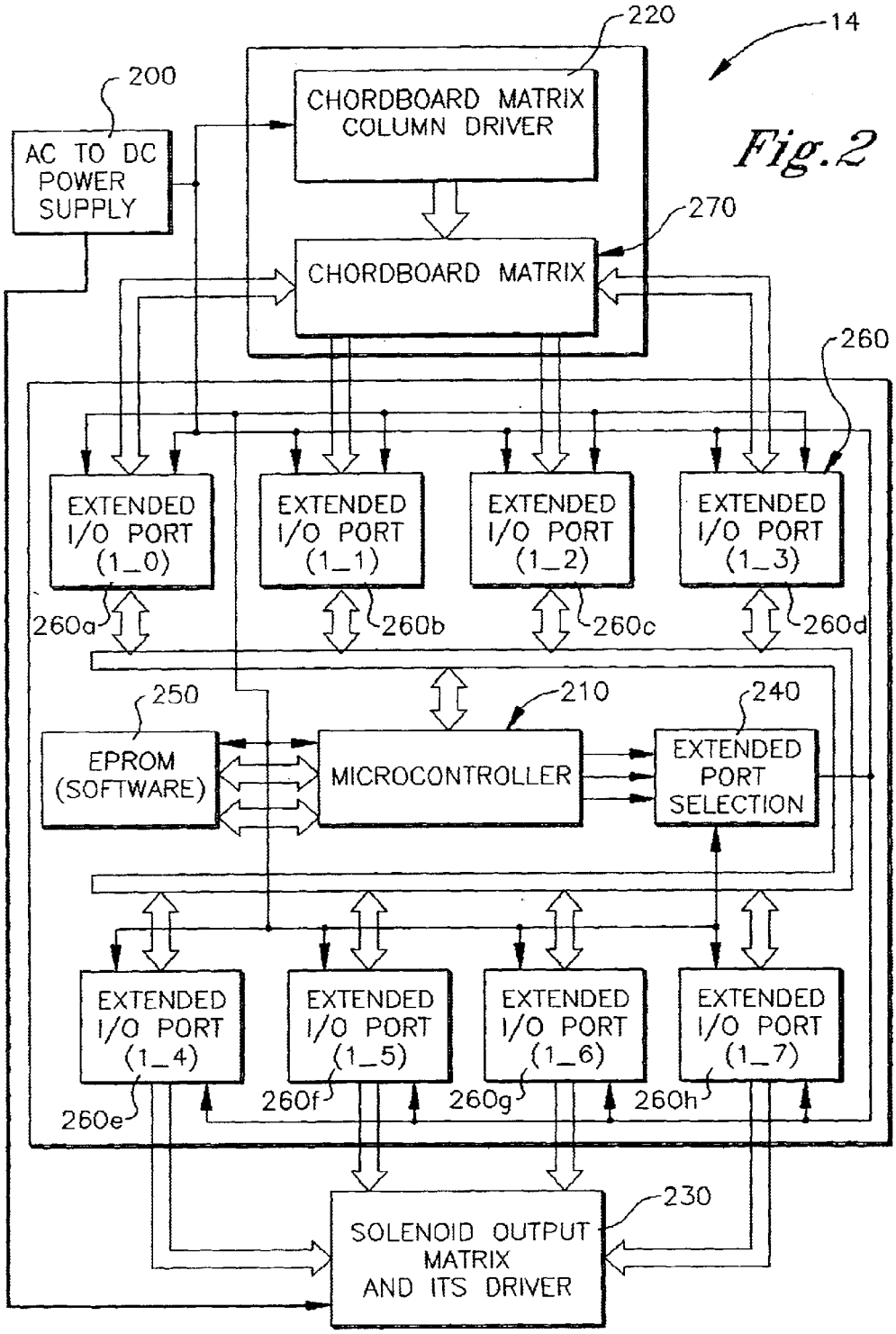
FIG. 2 is a block diagram of a control system for the present invention.

Now referring to FIG. 2, a block diagram of the control system 14 is shown. The control system 14 receives the real time chordboard 12 input, processes input data with specific logic, then outputs to the stringed instrument 16 to allow the desired chords to be played. The three overall functions of the control system 14 are as follows. (1) Chordboard management includes chord matrix scan and search, power driving, synchronizing, chord coding, error detection and communicating. (2) Function control includes chord code analysis, system management, control logic realization, and result processing. (3) Output management includes output matrix analysis, power driving, synchronizing, and communicating.

The overall operation of the control system 14 will now be described. An AC-DC power supply 200 provides D.C. power to drive an appropriately selected microcontroller 210, a compatible chordboard matrix column driver 220, and an equally compatible solenoid output matrix driver 230. The microcontroller 210, in turn, drives an extended port selection function 240, and an EPROM software module 250. Each of a plurality of extended I/O ports 260 communicate with the microcontroller 210. Initiation of a chordboard matrix 270 begins the operation of and coordination between all of the just described components of the control system 14. In a second embodiment of the control system 14, a typical ribbon cable (not shown) provides an electrical link between an A.C. power source, such as a standard external wall-mounted A.C. power outlet, an external control system (unnumbered and not shown), and the programmable system 10. In this second embodiment, the external control system is mounted in an appropriately sized, preferably metallic, container.

Generally speaking, the control system 14 provides chordboard management, system function control and output management. The heart of the control system 14 is the microcontroller 210. Preferably, the microcontroller is an 80C51, a widely used and inexpensive component. The microcontroller 210 uses the plurality of I/O ports 260 to receive input data from the chordboard 12 (input unit) and send output data to the stringed instrument 16 (or output unit). In addition, the microcontroller 210 typically uses an EPROM software module 250 to store the programs which manage the entire programmable system 10 and execute all functions. Because the control logic is complex with a large look-up table, the memory capability is extended by using the plurality of extended I/O ports 260. The extended memory of the control system 14 holds all the software code for the system input management, control logic and output management functions. The microcontroller 210 directly controls the extended memory. The software module 250 allows the entire programmable system 10 to operate through its novel look up table.

To fulfill the chordboard management function, the design of the control system 14 preferably combines a chordboard controller and system controller together into one microcontroller 210. In this design choice, the chordboard connects the system 10, without microcontroller 210, by normal chordboard matrix lines, and the microcontroller 210 manages the chordboard input functions. These functions include driving and scanning each row line and column line sequentially with the time synchronizing and loop, receiving the specific chord or chords, and processing that input. To manage the data in the programmable system 10, the preferred design choice is to use the plurality of I/O ports 260 to extend the number of I/O lines for input, output and memory extension, including managing the sequencing of multiple inputs.

Continuing with FIG. 2, the EPROM software module 250 uses a look up table to store the large number of potential inputs. The relationship between the input and output is defined by the language character structure. In the present invention, the character structure or selection is random with the three modes of input. These input modes will be described in more detail when describing FIG. 4.

More specifically, the I/O ports 260 assist with the chordboard scan input and output, and providing extended memory. As shown in FIG. 2, the plurality of I/O ports 260 are designated P1_0 through P1_7. They operate serially, which means, for instance, that at any given time, a decoder selects only one port, such as P1_0 260*a*, which is extended by an 8 bits latch register. This port can operate either as a "WRITE" or "READ" port through the microcontroller 210. After executing this operation, the decoder selects another extended port, such as P1_1 260*b*, while the first extended port P1_0 260*a* maintains its logic status (either high or low) in the latch register. More specifically, 14 lines of the P1_0 and P1_1 ports 260*a*, 260*b* are used as row lines of the chordboard matrix, and 16 lines of the P1_2 and P1_3 ports 260*c*, 260*d* are used as the column lines of the chordboard matrix which form 216 chords (16×14=224). Overall, ports 1_0 to 1_3 have the function to drive the chordboard matrix and read which chords are pressed.

As the chords are scanned, the software module 250 is working as follows. The microcontroller 210 selects the P1_0 port 260*a* or P1_1 port's 260*b* one line to cause a data distribution circuit to pull one line of 16 normally high row lines to a low voltage. Then the microcontroller 210 selects another two of the extended ports 260, P1_2 260*c* and P1_3 260*d*, and reads the status byte of the ports 260 one by one. In other words, as any chord on the chordboard 12 is pressed, the microcontroller 210 interrogates the software module 250 and a particular look-up table location is selected to allow the desired chords to be played. Each one of the 14 rows is scanned sequentially by the microcontroller 210 to determine if any row is pressed. If so, the microcontroller registers the logic status as high or low. In addition, the 16 column lines are scanned to determine if any column is pressed, resulting is its logic status being registered high or low. This operation is carried out continuously.

Extended I/O port P1_4 260*e* and P1_5 260*f* function as output matrix row control, while P1_6 260*g* and P1_7 260*h* function as output matrix column control. Overall, ports 1_4 to 1_7 have the function of determining and driving the solenoid output. Logic options include 1) row and column low, 2) row low and column high, 3) row high and column low, and 4) row high and column high.

Figure 3A:
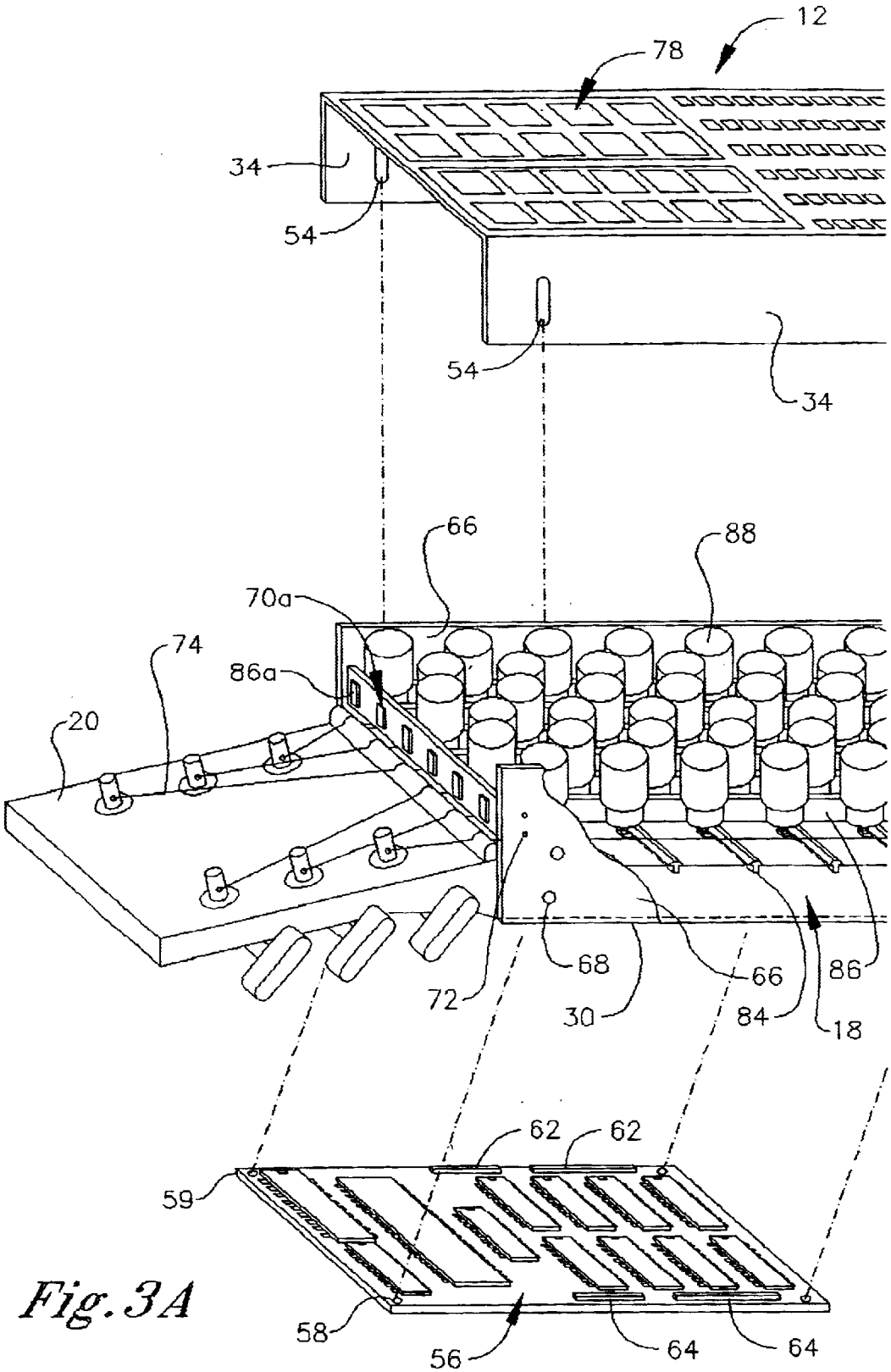
FIG. 3A is a first part of an enlarged partial perspective representation of the present invention showing more clearly a plurality of mechanical attachment mechanisms for the chordboard to the guitar, and also illustrating a control system underneath the guitar with a plurality of electronic headers in the control system.

Next referring to FIG. 3A, an enlarged perspective partial representation of the present invention more clearly shows the mechanical attachment between the chordboard 12 and the modified fretboard 18. More specifically, a plurality of chordboard slotted holes 54 are drilled in the chordboard vertical sides 34. Then the chordboard vertical sides 34 are movably secured to a plurality of fretboard vertical sides 66. The slotted holes 54 are next manually aligned with a plurality of matching fretboard attachment holes 68. After alignment, a plurality of typical metal screws (not shown) are inserted into the slotted holes 54, and fretboard holes 68.

The modified fretboard 18 is also comprised of a plurality of spring presser rod holders 70. Each rod holder 70 is secured to opposing fretboard vertical sides 6 6 of the fretboard 18 through a plurality of holes 72*a* (not shown in FIG. 3A) on either end of the holders 70 and matching holes 72 in the vertical sides 66. The plurality of holes 72*a* and the matching holes 72 are preferably vertically aligned. The means to secure the holders 70 is preferably metallic screws from an outer side to each fretboard vertical side 66 of the fretboard 18. A plurality of instrument strings 74 are removably secured on the neck 20, then pass under a first rod holder 70*a*, over the fretboard 18, under a second rod holder 70*b*, and ultimately over the sound box 22 and secured on an end of the sound box 22. The second rod holder 70*b* and the sound box 22 are shown later in FIG. 3B.

Continuing with FIG. 3A, the chordboard 12 is comprised of two major components: a preferably metallic base 76 and a typical membrane switch 78 mechanically incorporated into a chordboard top side 80 of the base 76. The metal used in the base 76 is preferably aluminum, although other appropriate light weight materials may be used. The base 76 is mechanically bent lengthwise in two bend locations 82 to provide the identically dimensioned sides 34. Also shown is the control system 14.

In the second embodiment, mentioned in the description of FIG. 1A, the control unit 14 is securely affixed to the underside 30 of the fretboard 18. More specifically, the control board 56 is secured with a plurality of screws (not shown) through the plurality of board securing holes 58.

Figure 3B:
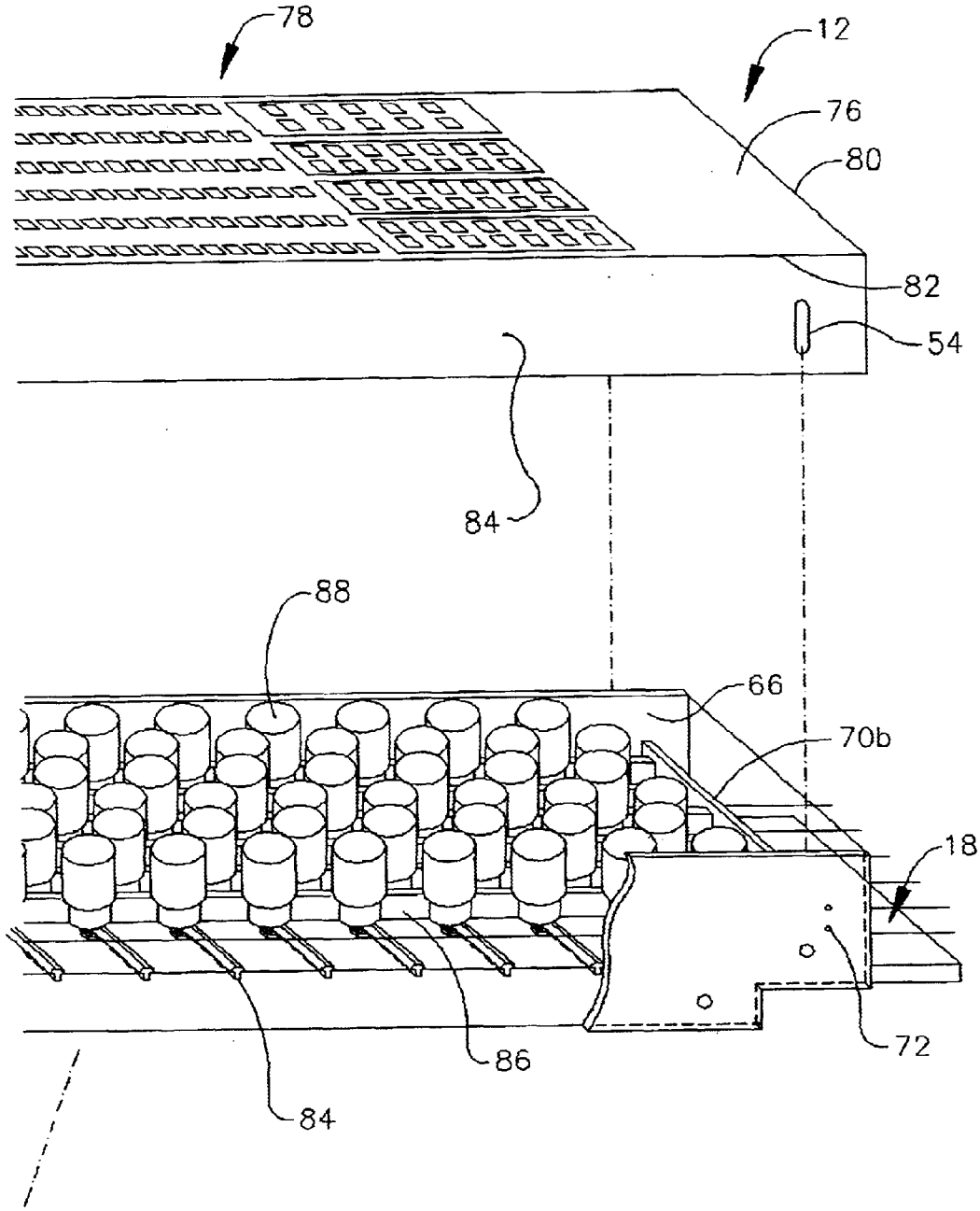
FIG. 3B is a second part of an enlarged perspective partial representation of the present invention showing more clearly a plurality of mechanical attachment mechanisms for the chordboard to the guitar.
Figure 4:
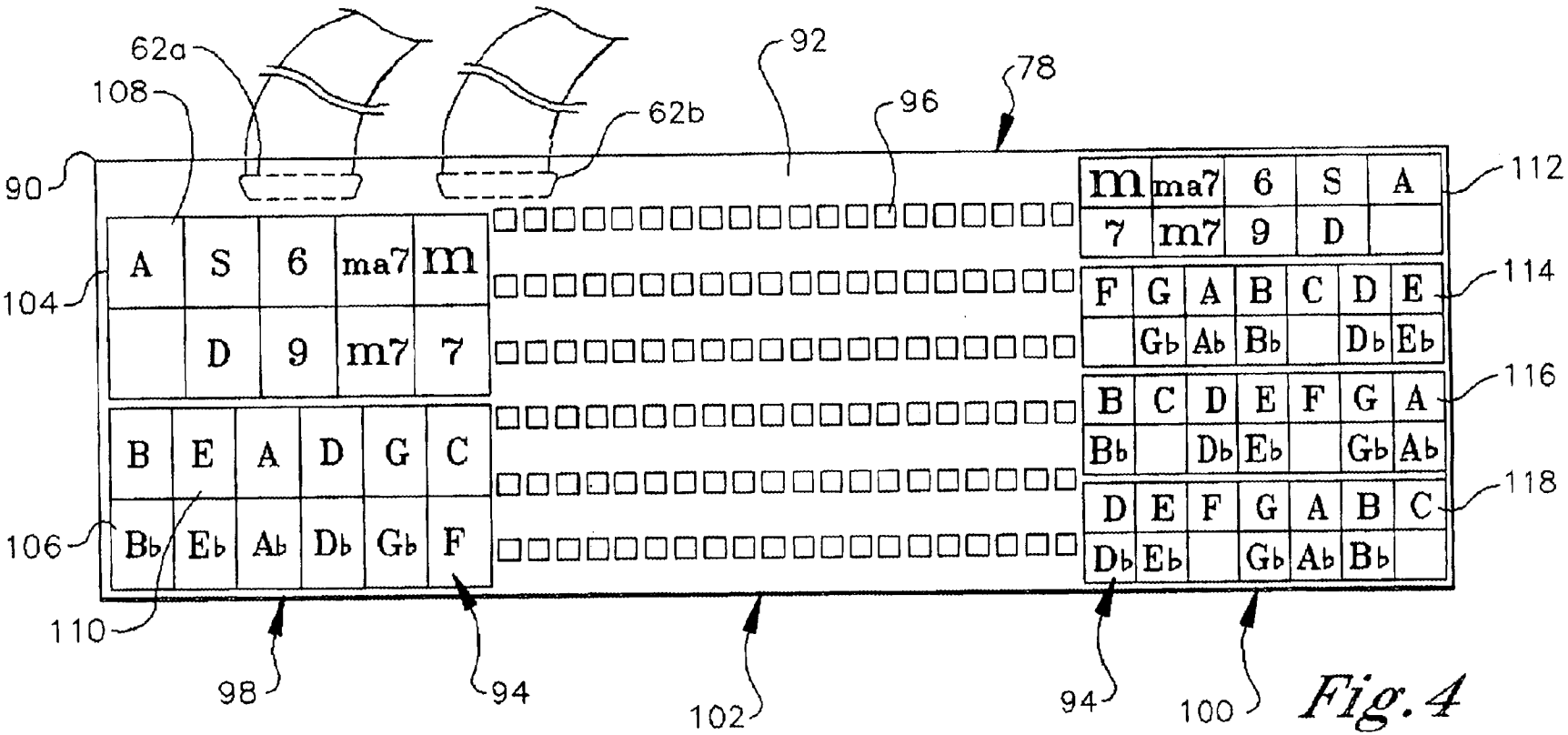
FIG. 4 is a top view of an enlarged partial representation of the chordboard showing a plurality of open chords,notes on membranes, and bar chords, in one embodiment according to the present invention.

Next referring to FIG. 3B, is a second part of an enlarged perspective partial representation of the present invention showing more clearly a plurality of mechanical attachment mechanisms for the chordboard to the stringed instrument 16. On the fretboard 18 are located a plurality of frets 84. These frets 84 are preferably molded rounded dividers underneath the strings 74. Also shown in this FIG. 3B are a plurality of string presser rods 86. These rods 86 are secured by friction in the rod holders 70*b*, 70*a*. Additional description of the rod holders is provided in the discussion of FIG. 9. The rods 86 function as holders of a plurality of solenoids 88 which are removably secured to the rods 86. The function and operation of the solenoids 88 are described in the discussion of FIGS. 5A, 8A and 8B. Referring now to FIG. 4, a top view of an enlarged partial representation of the chordboard 12 is shown. The membrane switch 78 has two headers 62*a*, 62*b* in an upper left corner 90 of the switch 78. These headers 62*a*,62*b* receive power from the plurality of headers 62 described in the control unit 14 in FIG. 1B. A first header is a row output header 62*a* to the control unit 14. A second header is a column output header 62*b* to the control unit 14. A plurality of embossed overlays 92 are securely affixed onto the membrane switch 78. The overlays 92 illustrate a first arrangement 94 of chords and notes in one embodiment according to the present invention. In addition, a plurality of fret membranes 96 are shown.

There are three types of chords and notes in the first arrangement 94, each classified by function. The first type is the non-major chords. These chords are m, 7, ma7, m7, 6, 9, S, D and A. "Ma" represents "major", while "m" represents "minor". The second type include the major open chords: B, E, A, D, C, F, Bb, Eb, Ab, Db, and Gb. The "b" represents a "flat". In addition, the second type includes the major bar chords. These are F, G, A, B, C, D, E, Gb, Ab, Bb, Db, and Eb. The third type is the matrix elements from 1 to 150 shown as individual unlettered membranes, the fret membranes 96, in FIG. 4. Hence, those familiar with chords and their combinations realize that these chord types represent 12+54+150=216 different chords. More specifically, the present invention includes the following novel arrangement of chords in FIG. 4. The selected chords are as follows: major chords, Gb, Eb and Bb; minor chords, Cm and Abm; seventh chord, Db7; minor seventh chord, Bbm7; major seventh chord, Bma7; major sixth chord, B6; ninth chord, C9; the suspended, F sus; the diminished, A°, C °, Eb °, F#°; and the augmented, $F^+$, $A^+$, $C\#^+$.

The left side 98 of the first arrangement 94 displays the names of the open chords and scales, while the right side 100 of the first arrangement 94 displays the names of the bar chords. The middle part 102 of the first arrangement 94 exhibits 120 fret membranes 96 for each half tone of each string up to the twentieth fret. There are 120 fret membranes 96 for the stringed instrument 16 shown in FIG. 1A. The arrangement of the open chords on the left side 98 of the first arrangement 94 enables one to play one hundred and seventeen (117) open chords. On the left side 98, there are two blocks 104, 106, top and bottom. The top block 104 contains the abbreviations of the nine non-major chords such as m, 7, ma7, m7, 6, 9, S, D, and A. The abbreviation "m" stands for minor; "7", dominant 7th; "ma7", major 7th; "m7", minor 7th; "6", 6th; "9", 9th; "S",sustained; "D", diminished; and "A", augmented.

A single non-major chord membrane 108 of the top block 104 on the left side 98 of the first arrangement 94, however, is not designed to be used alone. Each non-major chord membrane 108 is to be used with one of the twelve major chord membranes 110 in the bottom block 106. To play the non-major chords, the first touch should be given to any one of the single non-major chord membrane 108 of the top block 104 and then the second touch must be given to any one of the twelve major chord membranes 110 in the bottom block 106.

Continuing the description, the bottom block 106 contains the twelve major chords such as B, E, A, D, G, C Bb, Eb, Ab, Db, Gb, F. The abbreviation "B" stands for B major; "E", E major; "A", A major; "D", D major; "G", G major; "C", C major; "Bb", B major; "Eb", Eb major; "Ab", Ab major; "Db", Db major; "Gb", Gb major; and "F", F major. These twelve major chords in the bottom block 106 require only one touch by any finger. And the duration of the touch on the major chord membranes 110 equals to the beat of the music.

In the middle part 102 of the first arrangement 94, there are six columns and twenty rows, one column for each string and one row for each fret. Each row has twenty fret membranes 96; thus, there are 120 (20×6) fret membranes 96 altogether. Each fret membrane 96 corresponds with a half tone of a string at the twenty frets. The first row with the twenty fret membranes 96 represents the first string (D sound) from the bottom of the stringed instrument 16; the second row, the second string (A sound); the third row, the third string (E sound); the fourth row, the fourth string (B sound); the fifth row, the fifth string (G sound); the sixth row, and the sixth string (D sound). The 120 fret membranes 96 in the middle part 102 of the first arrangement 94 allow a player to play the scales of the stringed instrument 16, such as a six stringed guitar. The scales are located between the left side 98 and the right side 100 of the embossed overlays 92. A player can easily, therefore, move his fingers either to the open chords on the left side 98 or to the bar chords on the right side 100 of the first arrangement 94.

On the right side 100 of the first arrangement 94, there are four right side blocks 112, 114, 116, and 118. The first right side block 112 of the first arrangement 94 is the same as the top block 104 of the left side 98. The second 114, third 116, and the fourth blocks 118 each contains the twelve major chords that require only one touch by any finger. The second block 114 represents the overlays 92 for the twelve major root 6 bar chords. The third block 116 displays the overlays 92 for the twelve major root 5 bar chords. And the bottom block 118 displays the overlays 92 for the twelve major root 2 bar chords.

On a conventional guitar, the root 2 bar chords are formed by the C major open chord. Yet this allows only major chords to be played because of awkward fingerings. The other nine non-major types of chords displayed on the top block 104 have not been sounded by the root 2 string because of awkward fingerings. However, with the present invention, the root 2 bar can now sound all nine non-major types of chords as the root 6 and the root 5 do. Therefore, these eighty-four (84) new chords of the root 2 bar are added to the system memory of the programmable system 10. Any bar chords played by the root 6 and the root 5 can now also be sounded by the root 2.

The chord arrangement on the right side 100 of the first arrangement 94 enables one to play the three hundred and nine (309) bar chords, in addition to one hundred seventeen (117) open chords. On the fingerboard of a conventional six-string guitar, for example, a flat chord comes before the natural major chord. To make playing easy and convenient, however, the names of the flat chords are placed below the name of the natural major chord. And the size of the chordboard 12 can be reduced or enlarged vertically (in width) and longitudinally either on the basis of the number of strings of a string instrument or even for relatively smaller or larger fingers.

Another novel advantage of the present invention is having more sounds available. For example, the A sound (fifth string), and the E sound (sixth string) can be easily played. Note the close proximity of these two chords in FIG. 4. Normally, in a conventional six string guitar, these chords cannot be played because one's fingers cannot reach them all because of the distance required for the fingers to stretch. In other words, normally, the fifth and sixth strings are deadened because they can't be reached. In the present invention, they can be played, thereby making more sounds available.

Still another advantage to the present invention is the ability to easily play the Ebm chord. With conventional guitars, one must practice many times in order to be able to hold this chord. Yet a novel feature of the present invention is that with no practice at all only two fingers are needed to play this chord. Note the proximity of the Eb chord and the "m" in FIG. 4. Additionally, only one finger is needed to play any of the major chords. It only requires one to press one membrane 106, 108 for each chord.

Continuing with FIG. 4, three different novel modes of operation are possible in the present invention. The first is one-to-one input & output. This mode provides exactly one output for each input; that is, manually pressing one of the matrix elements. The second mode is one input to multiple output. This mode provides for multiple outputs for each single input (that is, manually pressing) of a major open chord. The third type is the two input to multiple output. This type allows an input of a non-major chord and a major open chord as inputs corresponding to a fixed set of multiple outputs. These novel modes allow just one novel example to be described. In contrast to a conventional guitar, the present invention allows a player to play a note for as long as desired. One merely holds the membrane switch 78 in the down or pressed position through the desired membranes 96, 108, 110. Still another novel feature is that while holding down one note, another finger can be used to press and release one or more membranes 96, 108, 110 in succession. This feature allows one to ad lib against virtually any note!

Another example of a novel advantage of the present invention is the expanded sound range over conventional stringed instruments. Recall that a piano with a standard keyboard covers seven octaves of sound. Normally, a conventional six-string guitar has a range of three octaves plus five notes. With engineering design changes in dimensioning, for example, the fretboard 18 and the chordboard 12 could be modified to be larger in size. Therefore, a guitar may be designed to have at least ten strings. It is easily understood by those skilled in music that the sound range of such a guitar would reach a high F, a full six octaves high compared to a standard piano! Yet another novel feature of the present invention is that all strings may be strummed. One can sequentially press all six of the matrix elements 1–150 in a given column. With a conventional guitar, awkward fingering prevents strumming all strings. Therefore, the sound volume of the lower strings, that is, the fifth and sixth strings, is increased.

Another novel feature of the programmable system 10 is its adaptability to many other stringed instruments. For instance, measuring the dimensions of the various stringed instrument fretboards permits engineering design changes to modify the described fretboard 18 and chordboard 12. Fixed fret systems include the banjo, mandolin, and bass guitar, while those instruments without a fixed fret system include the violin, cello, and contrabass. In addition, another novel feature is that the programmable system 10 can produce harmonies on instruments which have never been able to play harmonies before. Also, in the present invention, chords are programmable into various stringed instruments. For example, as seen in the microfiche appendix, 477 chords are programmable into the present invention for a novel 10 string guitar. In addition, 272 chords are programmable for a banjo. For a mandolin, 255 chords are programmable; and 120 chords are programmable for a base guitar.

Figure 5A:
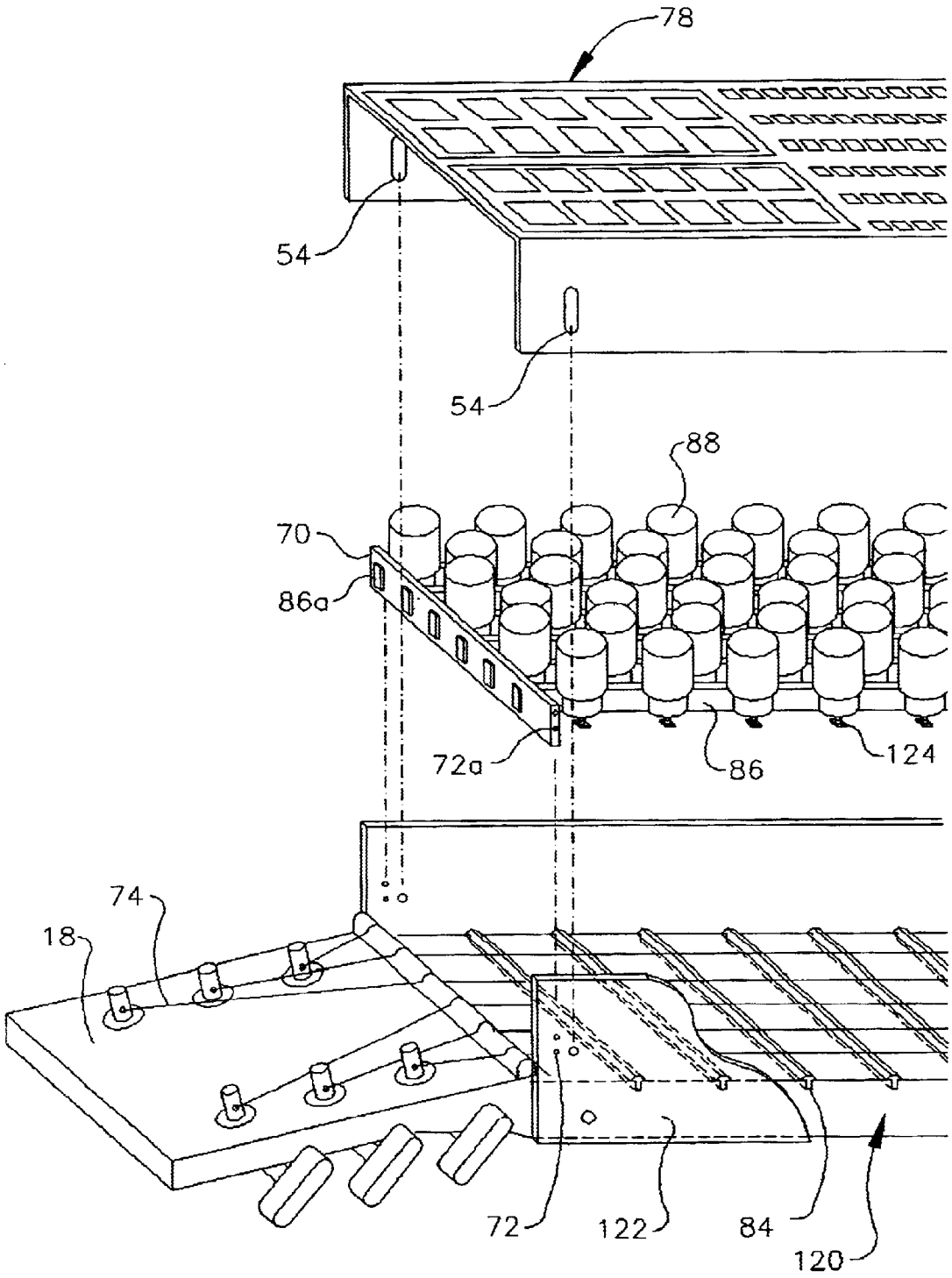
FIG. 5A is a first part of an enlarged exploded partial perspective representation of a fret housing, including the solenoids, according to the present invention.

Now referring to FIG. 5A, an enlarged partial perspective representation of a fretboard housing 120. The housing 120 comprises a housing base 122 into which a plurality of frets 84 are molded, preferably using a glue material. The major difference between the housing 120 in the programmable system 10 and the conventional fingerboard is that there is no board against which the fingers can press strings. The programmable system 10 uses part of the solenoids 88, not fingers, to press the strings.

Also shown in FIG. 5A are the plurality of string presser rods 86. The exploded view shows the presser rods more clearly than when previously described in the discussion of FIG. 3A and 3B. These rods 86 are secured by friction in the rod holders 70*b*, 70*a*. More specifically, each string presser rod end 86*a* of the presser rods 86 are seen inserted into each rod holder 70.

Figure 5B:
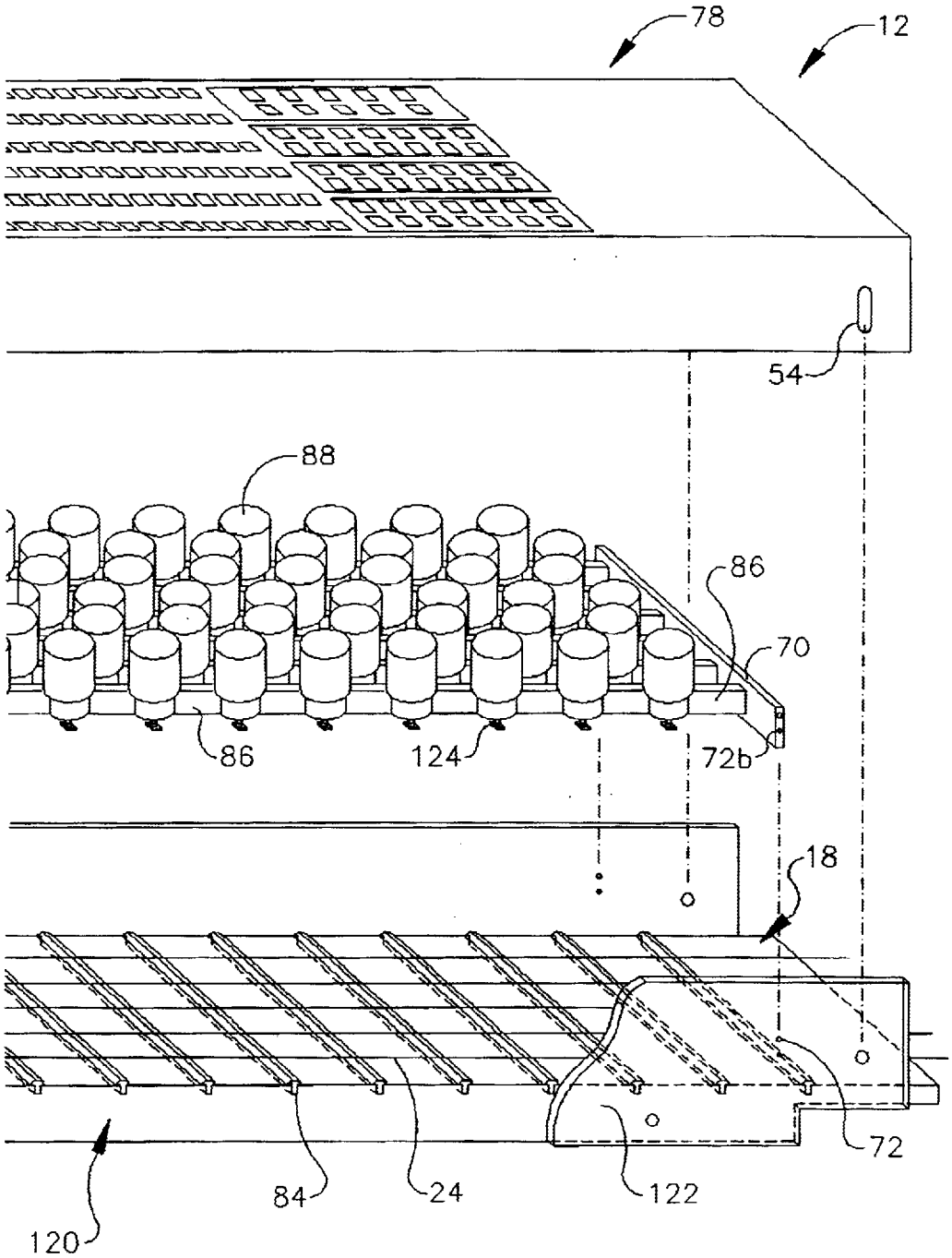
FIG. 5B is a second part of an enlarged exploded partial perspective representation of a fret housing, including the solenoids, according to the present invention.

Now referring to FIG. 5B, an enlarged exploded partial perspective representation of the fretboard housing 120 is shown, including the solenoids 88, according to the present invention. The string presser rods 86 function as holders of the plurality of solenoids 88 which are removably secured to the rods 86. Design options exist for the manner of removably securing the solenoids 88 to the rods. One option is for the solenoids 88 to be screwed into each presser rod 86. In FIG. 5B, a solenoid "T" shaped base 124 is shown as part of each solenoid 88. The "T" shaped base 124 is moved downward upon activation of each individual solenoid 88 to press against a specific string 74 underneath the activated solenoid 88.

Figure 6:
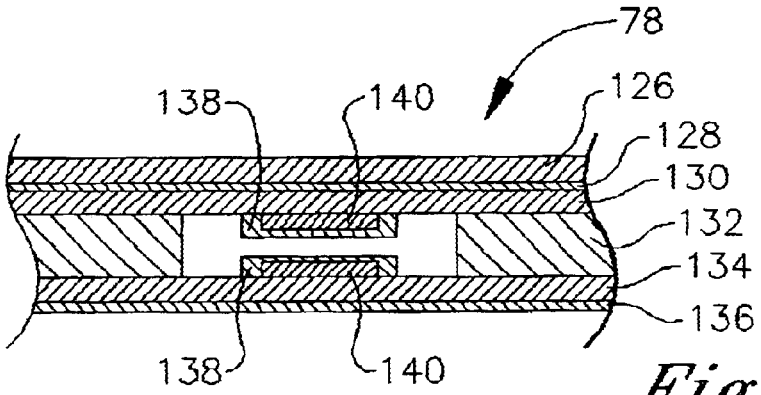
FIG. 6 is an enlarged partial schematic section representation of a typical membrane switch as previously shown in FIGS. 1A, 3A, 3B, 4, 5A, and 5B according to the present invention.

Next referring to FIG. 6, an enlarged partial schematic section representation of the typical membrane switch 78 is illustrated as previously shown in FIGS. 1,2, and 3. The "sandwich" construction of the switch 78 typically comprises a plurality of layers. The layers are listed from top to bottom as used in the chordboard 12 for illustrative purposes only, since the basic technology of membrane switches is well-known. The first layer is a graphic overlay 126, affixed to the next layer, a graphic adhesive layer 128. Next comes an upper membrane circuit 130, an insulating spacer layer 132, the lower membrane circuit 134, and finally a rear adhesive layer 136. The rear adhesive layer could also be called glue tape. The circuit board of the upper membrane circuit 130 is comprised preferably of a polyester material, as is the circuit board of the lower membrane circuit 134. Within the section view in FIG. 6 is also seen a plurality of carbon contacts 138 and a plurality of silver contacts 140.

Figure 7:
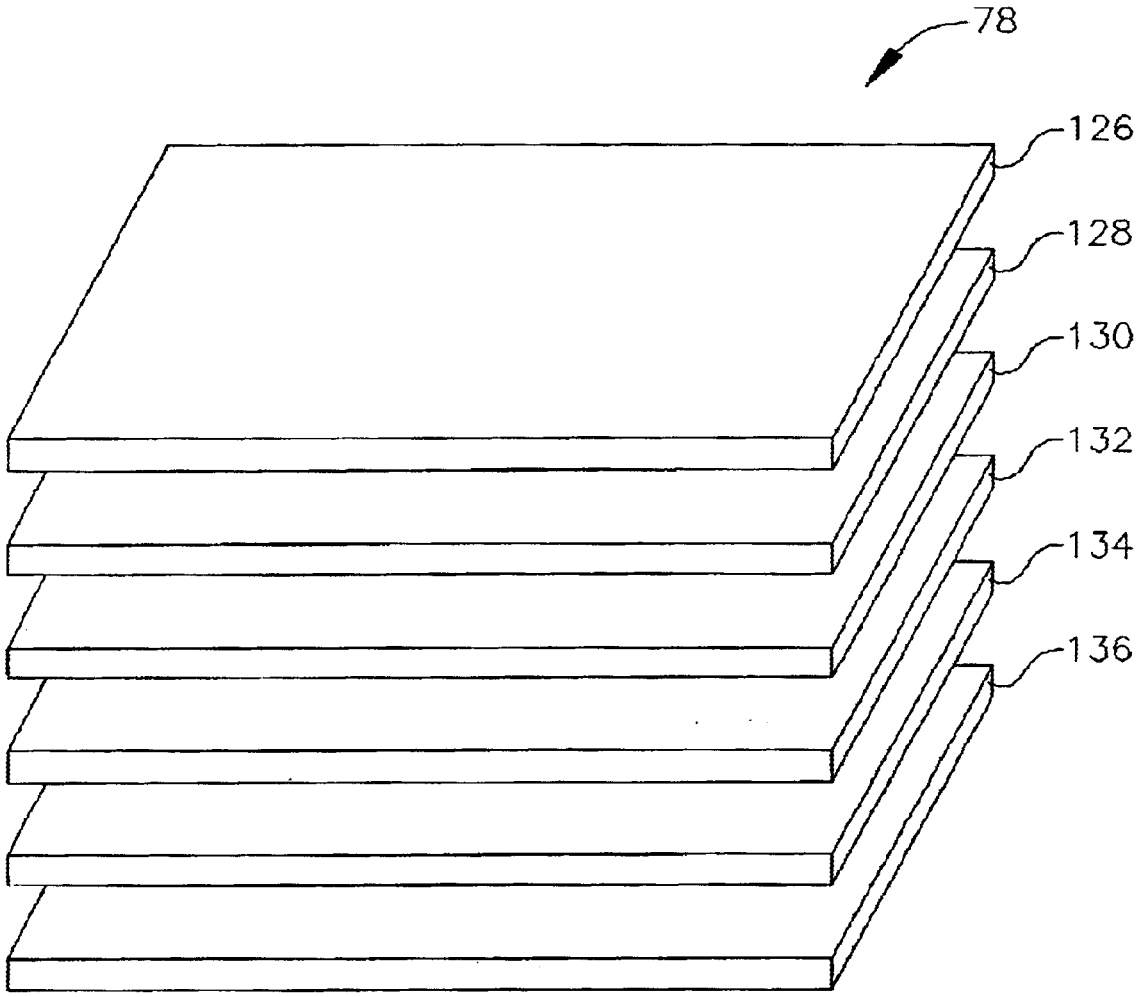
FIG. 7 is an exploded and enlarged partial schematic representation of a typical membrane switch as previously shown in FIGS. 1A, 3, 4, and 5 according to the present invention.

Referring to FIG. 7, an exploded and enlarged partial schematic representation of the typical membrane switch 78 as previously shown in FIGS. 1A, 3, 4, and 5 is shown. The "sandwich" construction of the switch 78 typically comprises a plurality of layers. The first layer is the graphic overlay 126, affixed to the next layer, the graphic adhesive layer 128. Next comes the upper membrane circuit 130, the insulating spacer layer 132, the lower membrane circuit 134, and finally the rear adhesive layer 136. The rear adhesive layer 136 could also be called glue tape.

Figure 8B:
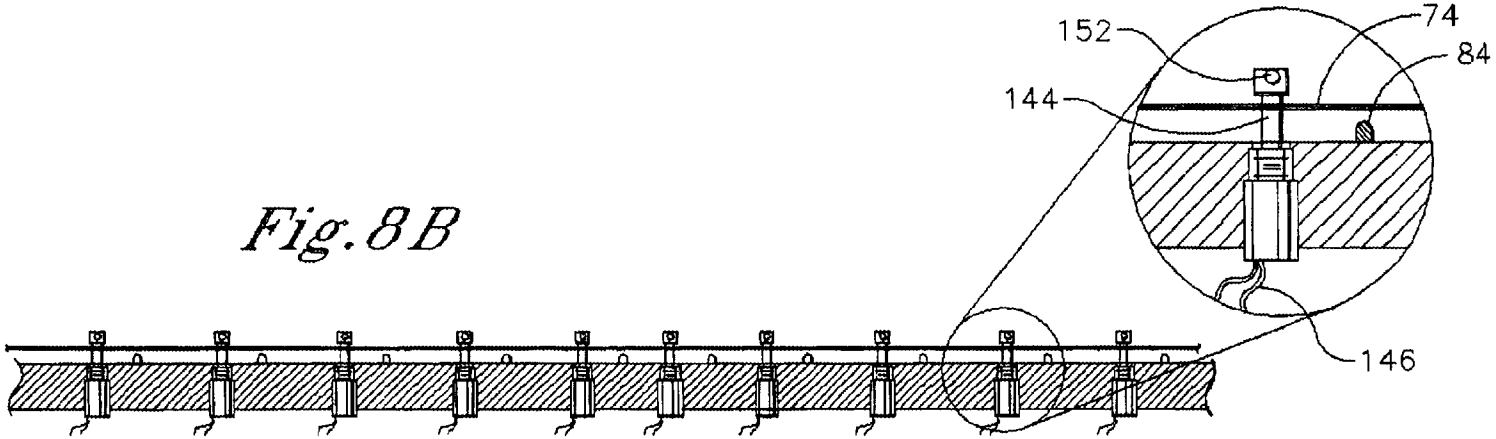
FIG. 8B is an enlarged schematic representation of a string presser rod with pull solenoids, according to the present invention.
Figure 8A:
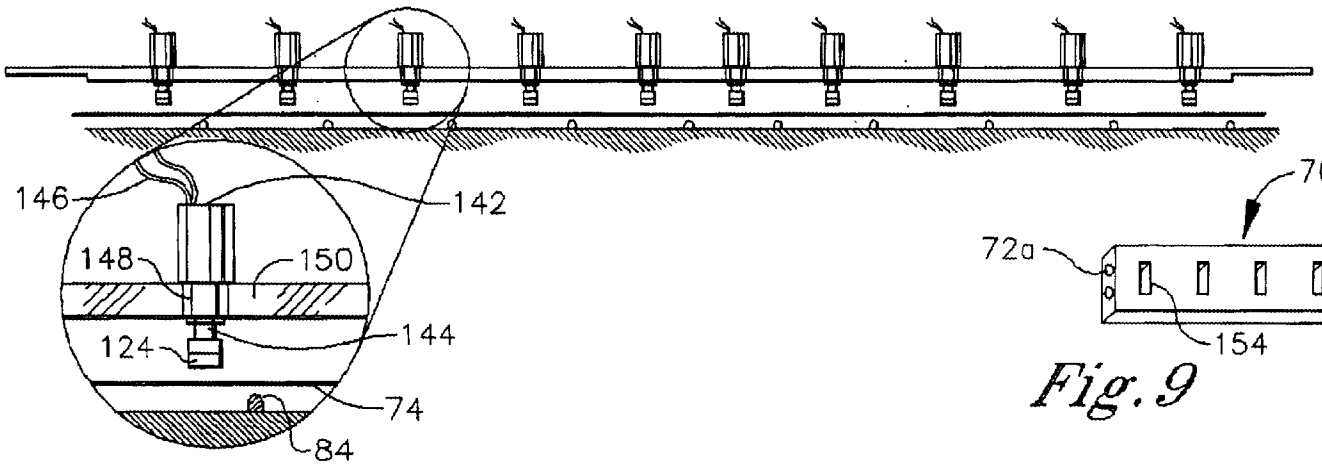
FIG. 8A is an enlarged schematic representation of a string presser rod with push solenoids, according to the present invention.

Now referring to FIG. 8A, an enlarged schematic representation of a string presser rod 86 with a plurality of solenoids 88 is shown. A top 142 of each push type solenoid 88*a* is pressed with a finger to initiate the input to the programmable system 10. A plunger 144 movably secured within each push type solenoid 88*a* is thrust in a downward direction thereby pressing the "T" shaped base 124 of the push type solenoid 88*a* onto the string 74. Each solenoid 88*a* provides the electromechanical means by which the sound range of the music is increased through the stringed instrument 16. The solenoids 88 function like fingers. Practically speaking, almost as many solenoids 88 can be incorporated into the programmable system 10 as desired. As the number of solenoids 88 increases, the sound range is similarly increased. The solenoids 88 and the EPROM software 250 act in concert to increase the sound range of the stringed instrument 16. The number of frets 84 and the number of strings 74 determine the total number of solenoids 88 in the programmable system 10.

For instance, if the number of frets 84 is 20 and the number of strings 74 is six, then the total number of solenoids 88 is 120 (20×6).

More specifically, the number of the solenoids 88 on each string presser rod 86 is determined by the number of the half tones on each string of the string instrument 16. The number of the string pressor rods 86 is determined by the number of strings 74 of the string instrument 16. For example, for a six stringed guitar, six string presser rods 86 are needed. For a six stringed guitar with twenty frets, twenty solenoids 88 are to be attached to each string presser rod 86. Therefore, the total number of solenoids 88 for a six string guitar would be 20×6 or 120. The string presser rods 86 carry at least one solenoid wire 146. Therefore, electric energy is supplied to the solenoids 88 along the columns and the rows.

The solenoids 88 required for the present invention are commonly found components. Each is secured onto each presser rod 86 just before each fret 84. The means of securing each solenoid 88 is through a design choice. Preferably, a threaded end 148 of each solenoid 88 is threaded into a correspondingly threaded presser rod section 150 of each string presser rod 86. In one embodiment of the solenoid 88, when the push type solenoid 88*a* is energized, a plunger 144 of the push type solenoid 88*a* plunges downwardly to press the string 74. In addition, the plunger 144 preferably incorporates the "T" shaped base 124 This "T" shape base 124 presses the desired string 74 when thrust in a downward direction. This "T"-shaped base 124 ensures that the desired string 74 will be pressed, despite string vibration or possible expansion or contraction of the string 74 or other components due to environmental conditions. The thickness of the string 74, the tension of the string 74, and the position of the string 74 that is pressed by the "T" shaped base 124 are all influential factors in selecting the kind of solenoid 88. The thicker string and the more tensive string may require a solenoid 88 with a plunger 144 that can move forcefully and quickly. It is certainly possible to employ different kinds of solenoids 88 even in the programmable system 10 to enable sufficient force to a particular plunger 144 to press its companion string 74 with the necessary tension.

Referring now to FIG. 8B, an enlarged schematic representation of a string presser rod 86 with a plurality of pull type solenoids 88*b* is shown. In this second embodiment of solenoids, 88 when the pull type solenoid 88*b* is energized, a plunger 144 also moves downwardly to engage the string 74 However, an end of the plunger 144 <Preferably> has a plunger hook 152 on it to pull down the string 74, instead of pressing down the string 74 as described in FIG. 8A in the first embodiment of the solenoid 88*a*.

Figure 9:
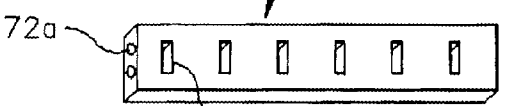
FIG. 9 is an enlarged schematic representation of a typical rod end holder for a six-string guitar, according to the present invention.

Next referring to FIG. 9, an enlarged schematic representation of the typical rod end holder 70 for a six-stringed instrument is shown. The rod end holder 70 contains a plurality of rectangularly shaped and evenly spaced windows 154. To vertically contain and channel the pressor rods 86, they pass through individual windows 154 in the rod end holders 70. The exact number of windows 154 is dependent on the number of strings 74 in the stringed instrument 16. The string presser rods 86 are secured by friction in the windows 154 based on appropriate dimensions in the rod holders 70*b*, 70*a*. As mentioned in the description of FIG. 1 but more clearly seen in FIG. 9, each end holder 70 has a plurality of holes 72, and matching holes 72*a*, which are vertically aligned in the rod end holder 70.

Figure 10:
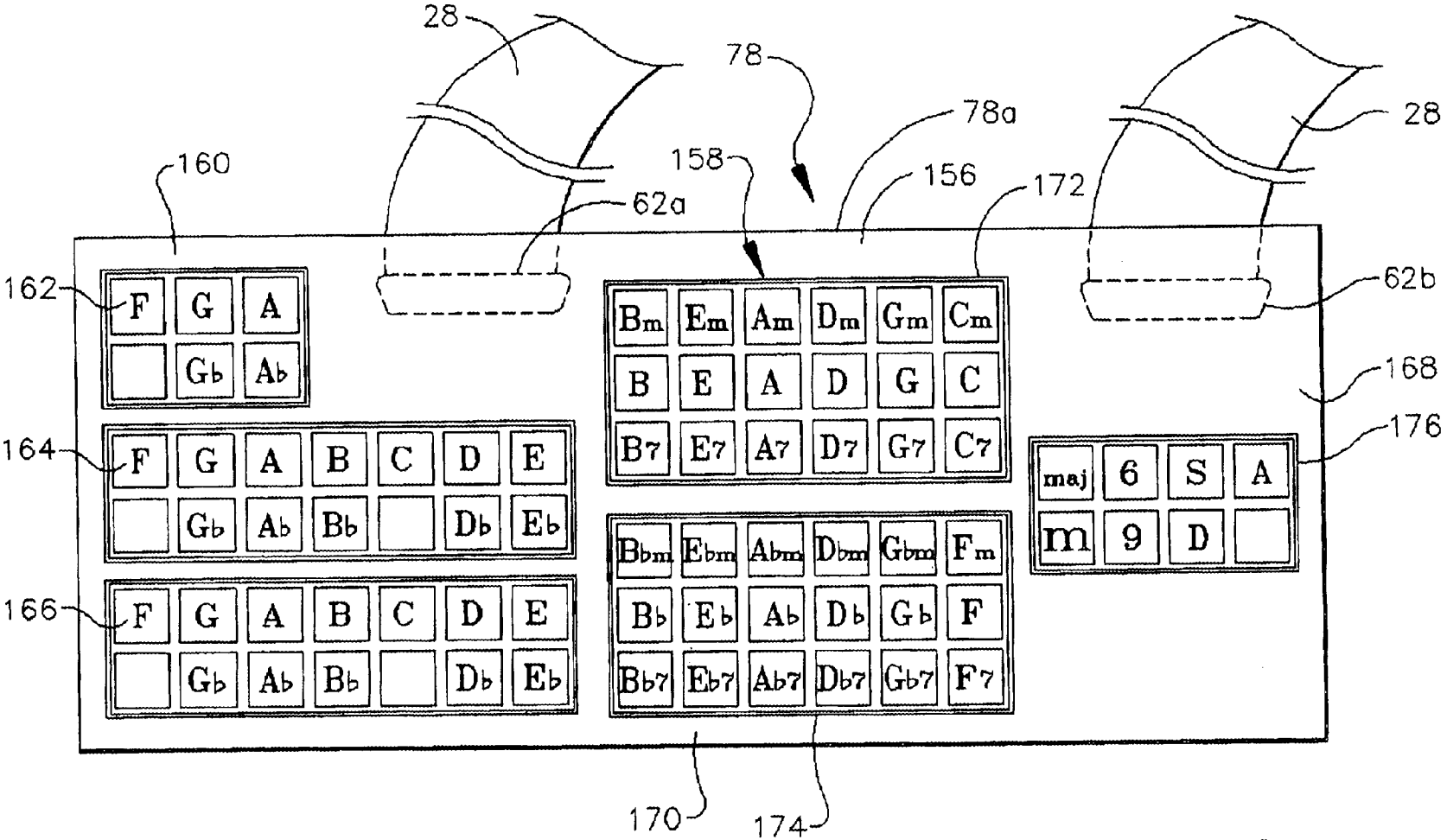
FIG. 10 is an enlarged partial schematic representation of another embodiment of the top view of the chordboard for an open chord musical instrument, according to the present invention.

Now referring to FIG. 10, an enlarged partial schematic representation of another embodiment of the top view of the chordboard 12 for an open chord musical instrument is shown. In this FIG. 10, the chordboard 12 has a second overlay 156 in a second arrangement 158 of chords and notes. This second arrangement 158 is called an open chord arrangement. More specifically, there are three types of chords and notes in the second arrangement 158, each classified by function. These three types are identical to those described in FIG. 4.

A left side 160 of the second arrangement 158 displays the names of the open chords and scales in a left upper block 162, a left middle block 164, and a left lower block 166. The left upper block 162 contains the abbreviations of several of the major open chords. These chords are F, G, A, Gb, and Ab. The left middle block 164 contains the abbreviations for the second type include the major open chords: F, G, A, B, C, D, E, Gb, Ab, Bb, Db, and Eb. The left lower block 166 repeats the left middle block 164. The left lower block 166 and the left middle block 164 contain the twelve major root 6 bar chords, just as the first arrangement 94 displayed these on the right side 100 of the first arrangement 94 described in FIG. 4.

The middle part 170 of the second arrangement 158 has a middle upper block 172 and a middle lower block 174. The middle upper block 172 displays the major open chords Bm, Em, Am, Dm, Gm, Cm, B, E, A, D, G, C, B7, E7, A7, D7, G7, and C7. The middle lower block 174 displays the major open chords Bbm, Ebm, Abm, Dbm, Gbm, Fm, Bb, Eb, Ab, Db, Gb, F, Bb7, Eb7, Ab7, Db7, Gb7, and F7.

The right side 168 of the second arrangement 158 displays the names of the non-major chords in one block 176; maj, 6, S, A, m, 9, and D. The second arrangement 158 provides an easy way for a player to play simpler songs using only major open chords. In addition, the second arrangement 158 allows easy movement from one chord to another using either one finger or two fingers because of the placement and duplication of the chords on the second arrangement 158 of the second overlay 156.

Summary of Operation of the Programmable System 10

The method of operation for the programmable system 1 0 will now be described. A summary of the steps of the method or process include the following.

1. providing AC power to the programmable system 10;
2. turning on an on/off switch 42; alternatively, from the chordboard 12 or from the control box 26;
3. Providing a plurality of arrangements 94, 158 of chords for easy reaching with a player's fingers, thereby facilitating playing said chords;
4. touching one membrane for a major chord or a half-tone;
5. touching, alternatively, two membranes for a non-major chord;
6. activating one or more membrane switches 78, 78*a*;
7. selecting solenoid drivers through a microcontroller 210;
8. retrieving programmed notes or chords from a software module's 250 look-up table, within said control box 26;
9. energizing solenoids 8 8 through said solenoid drivers;
10. activating plungers 78 in said solenoids 88;
11. pressing strings 74 in said system 10 by said plungers 144;
12. strumming, or alternatively, picking said strings 74; thereby producing sound through a sound box 22 of a stringed instrument 16;
13. lifting one's finger or fingers from said membranes;
14. deactivating one or more of said plungers 144, thereby stopping sound when said plungers 144 no longer contact said strings 74; and
15. repeating said touching one membrane for a major chord or a half-tone step; or, alternatively,
16. repeating said touching two membranes step.

A more detailed description of the operation follows. A single touch on any of the overlays 92 for the twelve major chords in FIG. 4 initiates the action of the programmable system 10. All the major chords, either of the open chords on the left side 98, the bar chords on the right side 100, and the half tone membranes of each string displayed in the middle part 102 of the programmable system 10 require only one finger to press all the strings 74 required for a major chord and for each half tone.

All of the other nine non-major types of chords require two touches: the first touch on a membrane of the nine non-major chords at the top block and then the second touch on any of the membranes of the twelve major chords.

The principle rule of playing bar chords is maintained in the first arrangement 158 of the bar chords in the second 114, third 116, and fourth block 118 on the right side 100 of the chordboard 12. In other words, the order of the bar chords and the twenty frets 84 on these three blocks 114, 116, 118 is strictly maintained so that the conventional principle rule of playing the bar chords avoids the need to learn a new way of playing the stringed instrument 16 using the programmable system 10. For example, to play the F and Bb bar chords with a typical six-stringed guitar, one needs to use the root 6 bar F chord on the first fret and then the root 5 bar Bb chord on the first fret respectively. However, using the programmable system 10 a player only needs to press the "F" on the second block 114 and "Bb" on the third block 116 to play the F and Bb bar chords.

When pressed, the membrane switch 78 causes power to flow to the solenoids 88. When the solenoids 88 are energized, the plungers 144 within the solenoids 88 plunge to press strings 74 at the designated frets 84. When a finger is lifted from an embossed overlay 92, the power is turned off and springs (not shown) within the solenoids 88 retract the plungers 144 to their original positions.

Each string presser rod 86 with its attached solenoids 88 has squarely protruded ends 86*a* that are inserted into the openings of the rod end holders 70. When all protruded ends 86*a* are inserted into the windows 154 of the rod end holder 70, the two rod end holders 70 are fastened to the base 122 of the housing 120 of the programmable system 10 by two screws from the outside of the housing 120. The rod end holder 70 maintains the position of the string presser rod 86 proximately above each string 74 when the plungers 144 are forcibly moved to press strings 74 against the fret housing 120.

When one's finger touches one of the major chord overlays 92, the overlay 92 closes the membrane switch 78, causing electric power to flow to the designated solenoids 88. Then the plungers 144 of the energized solenoids 88 plunge to press strings 24 and maintain pressure on their respective strings 74 as long as the m overlay 92 is being pressed.

Figure 11:
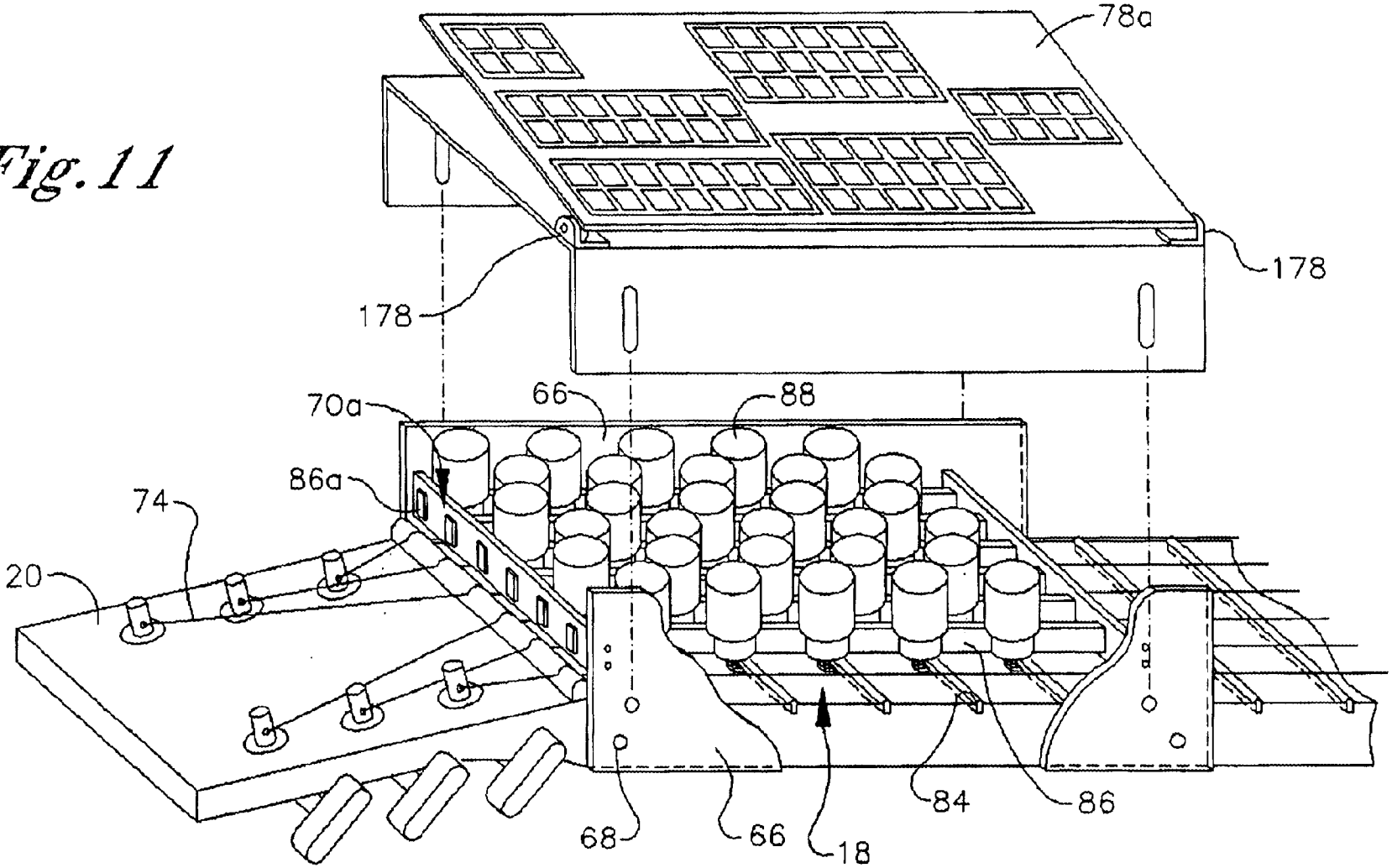
FIG. 11 is an enlarged partial perspective representation of the present invention showing a shorter embodiment of the chordboard with a hinged membrane switch, according to the present invention.

Next referring to FIG. 11, an enlarged partial perspective representation is shown of a shorter embodiment of the chordboard 12 with a hinged membrane switch 78*a* In this embodiment, a plurality of hinges 178 movably joins the membrane switch 78*a* to the chordboard 12. This embodiment permits easier playing of the programmable system 10 in the traditional manner of having a guitar strap around one's neck. More specifically, hinges 178, such as compact friction hinges, may be used on each end of the chordboard 12 to secure the membrane switch 78*a* to one side of the chordboard 12. This type of hinge is commonly used on laptop computers. These hinges allow for a plurality of angles from horizontal to the vertical. Typically, they are made of lightweight, corrosion-resistant plastic. The use of hinges on one side allows a player to adjust the overlay 156 to an individually suited angle to the horizontal for easier viewing and playing. More likely, the manner of playing the present invention is in a horizontal position, such as one might play an electronic keyboard.

Figure 12A:
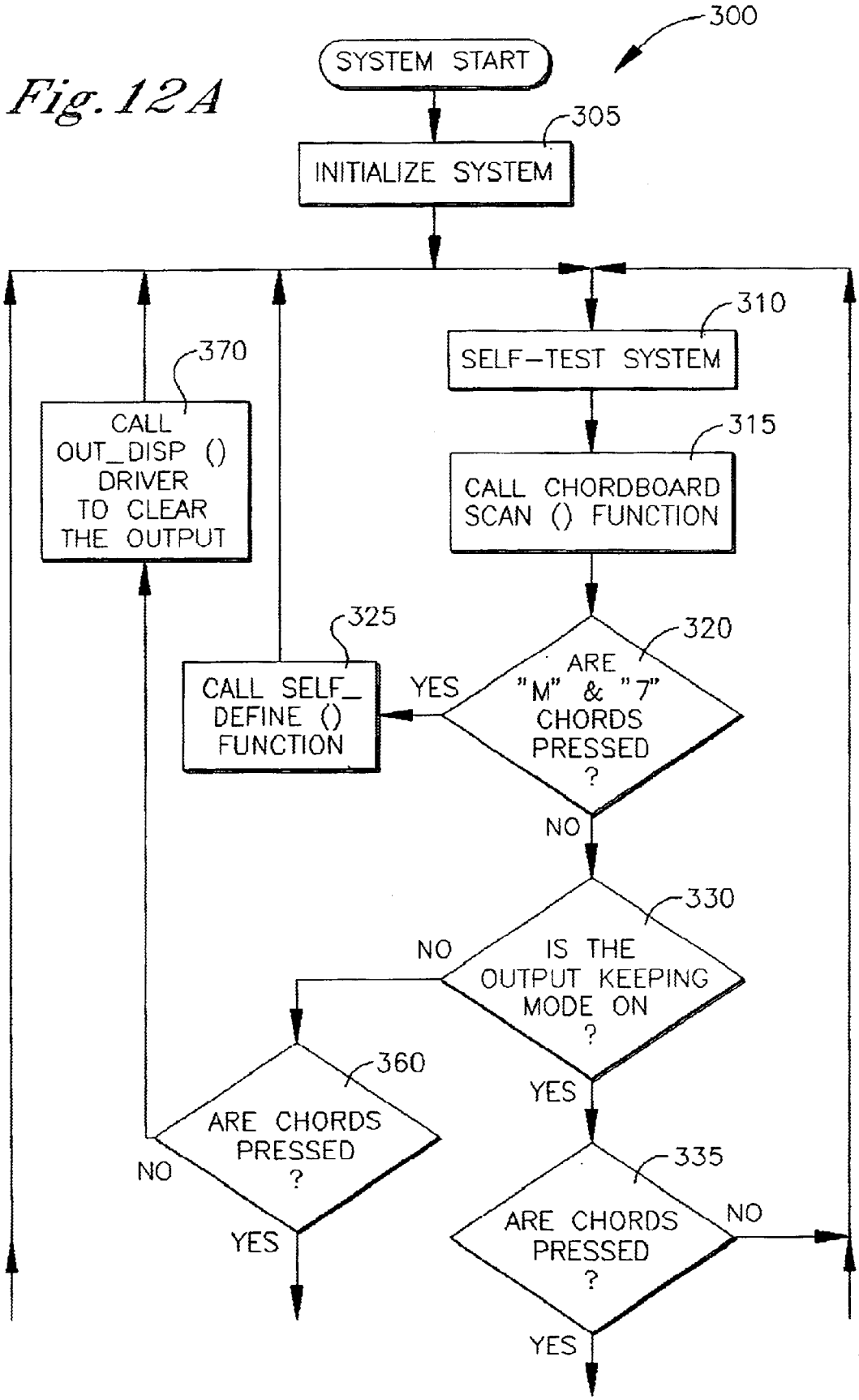
FIG. 12A is a flow chart of a system administration module for the control system, according to the present invention.

Referring now to FIG. 12A, a flow chart of a system administration module 300 for the control system 14 is shown. This administration module 300, comprising a plurality of steps, manages the entire programmable system 10 and controls and coordinates the other four modules to be described in subsequent drawings. Repeating the functions of the control system 14 from FIG. 2 is appropriate before the software module 250 is described. The three overall functions of the control system 14 are as follows. (1) Chordboard management includes chord matrix scan and search, power driving, synchronizing, chord coding, error detection and communicating. (2) Function control includes chord code analysis, system management, control logic realization, and result processing. (3) Output management includes output matrix analysis, power driving, synchronizing, and communicating.

Continuing with FIG. 12A, the first step is "initialize the system" 305. The second step is to "self-test the system" 310. The next step is to "call the chordboard scan function" 315. In other words, this software function "call chordboard scan ( ) function" drives and reads the chords as soon as one or more membrane switches 30 are pressed. Following this step, the system administration module asks "are the "m" and "7" chords pressed?" 320 If the answer to this step is "yes", the program proceeds to the "call self-define function" step 325 which is further described in FIG. 15. If the answer to the "are the "m" and "7" chords pressed?" step 320 is "no", the program proceeds to ask "is the output keeping mode on?" step 330. With a "yes" answer, the program asks the "are chords pressed?" step 335.

Figure 12B:
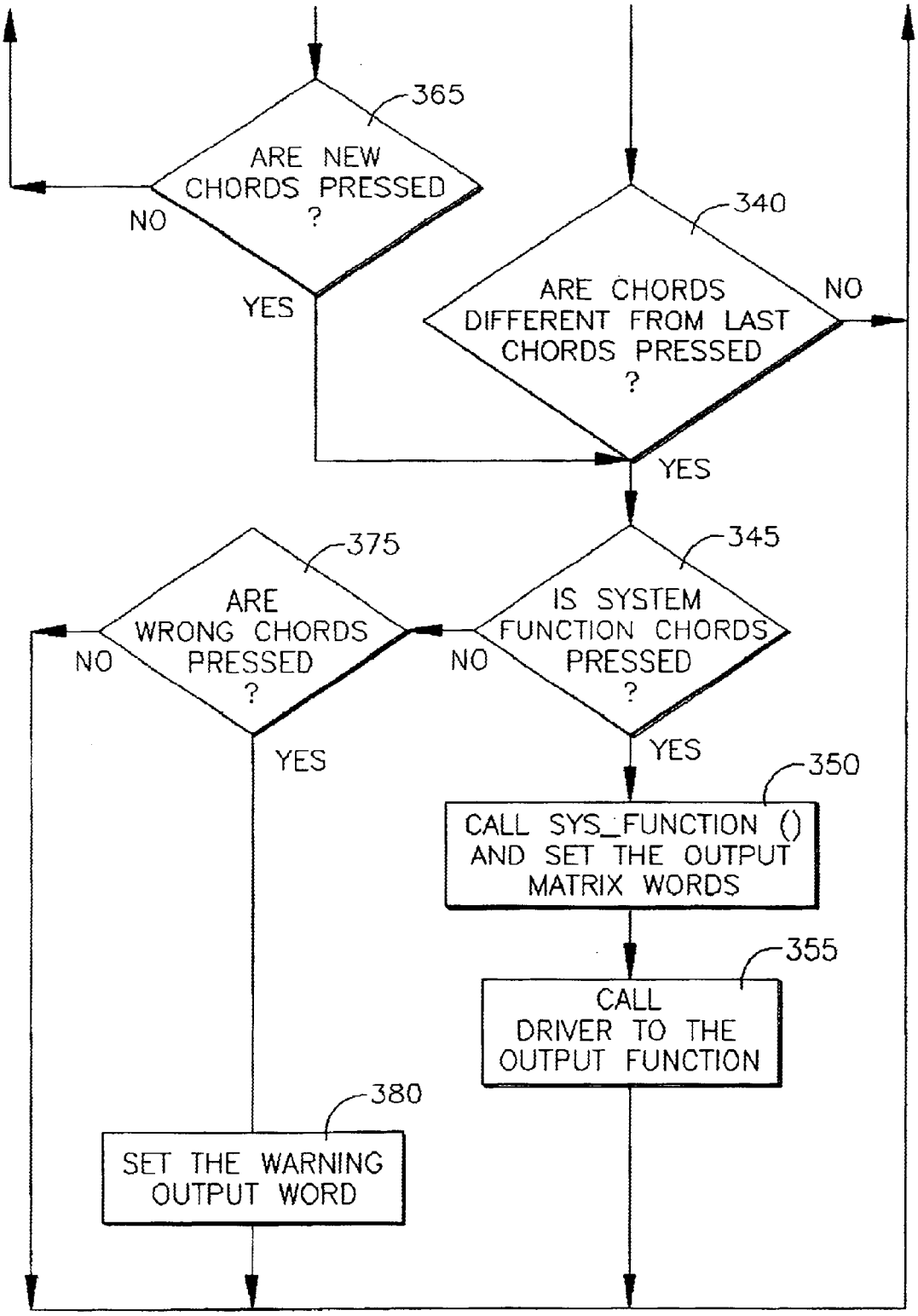
FIG. 12B is the second part of the flow chart of the system administration module for the control system, according to the present invention.

Now our description addresses FIG. 12B and returns as needed to referring to FIG. 12A. If the answer to the "are chords pressed?" step 335 is "yes", that is, chords are pressed, then the program proceeds to the next step asking "are the chords different from the last chords pressed?" step 340. If the answer is "yes", then the following step is to ask the "is the system function chord pressed?" step 345. A "yes" answer in this step directs the program to "call the system function and set the output matrix words" step 350. This software function "sys_function ( )" compares the chord or chords pressed with the selected I/O port to ensure the proper output word is selected from the look-up table. Then, immediately, the program proceeds to the "call out the driver to the output function" step 355, which is described in FIG. 16. Now we return to the options in the "is the output keeping mode on?" step 330. If the answer is "no", the program proceeds to ask the "are chords pressed?" step 360. If the answer is "yes", the program asks the next question "are new chords pressed?" step 365. If the program detects a "yes" answer, then the program rejoins the logic flow after the "are chords different from the last chords pressed" step 340. However, if the answer is "no" to the latest "are chords pressed?" step 360 question, then the program proceeds to "call out the driver to clear the output" step 370. In other words, the software function "out_disp ( )" drives the solenoids and changes their output.

At this point the program logic returns to the "initialize the system" step 305. Now we return to the options in the "is the system function chord pressed?" step 345. If the answer is "no", then the program asks "are the wrong chords pressed?" step 375. If "yes", then the program immediately performs the "sets the warning output word" step 380, thereby illuminating the warning LED light 48 (not shown). At this point, the program logic returns to the "initialize system" step 305. However, if the answer is "no", that is, the wrong chords are NOT pressed, then the program logic again returns to the "initialize system", step 305.

Now we return to the logic options to the "are the chords pressed?" step 335. If the answer is "no", then the program returns to the "initialize the system" step 305. Now we return to the options for the "are the chords different from the last chords pressed?" step 340. If the answer is "no", then the program returns to the "initialize the system" step 305. Finally, we return to the logic options to the "are new chords pressed?" step 365. If the answer is "no", then the program returns to the "initialize the system" step 305.

Figure 13A:
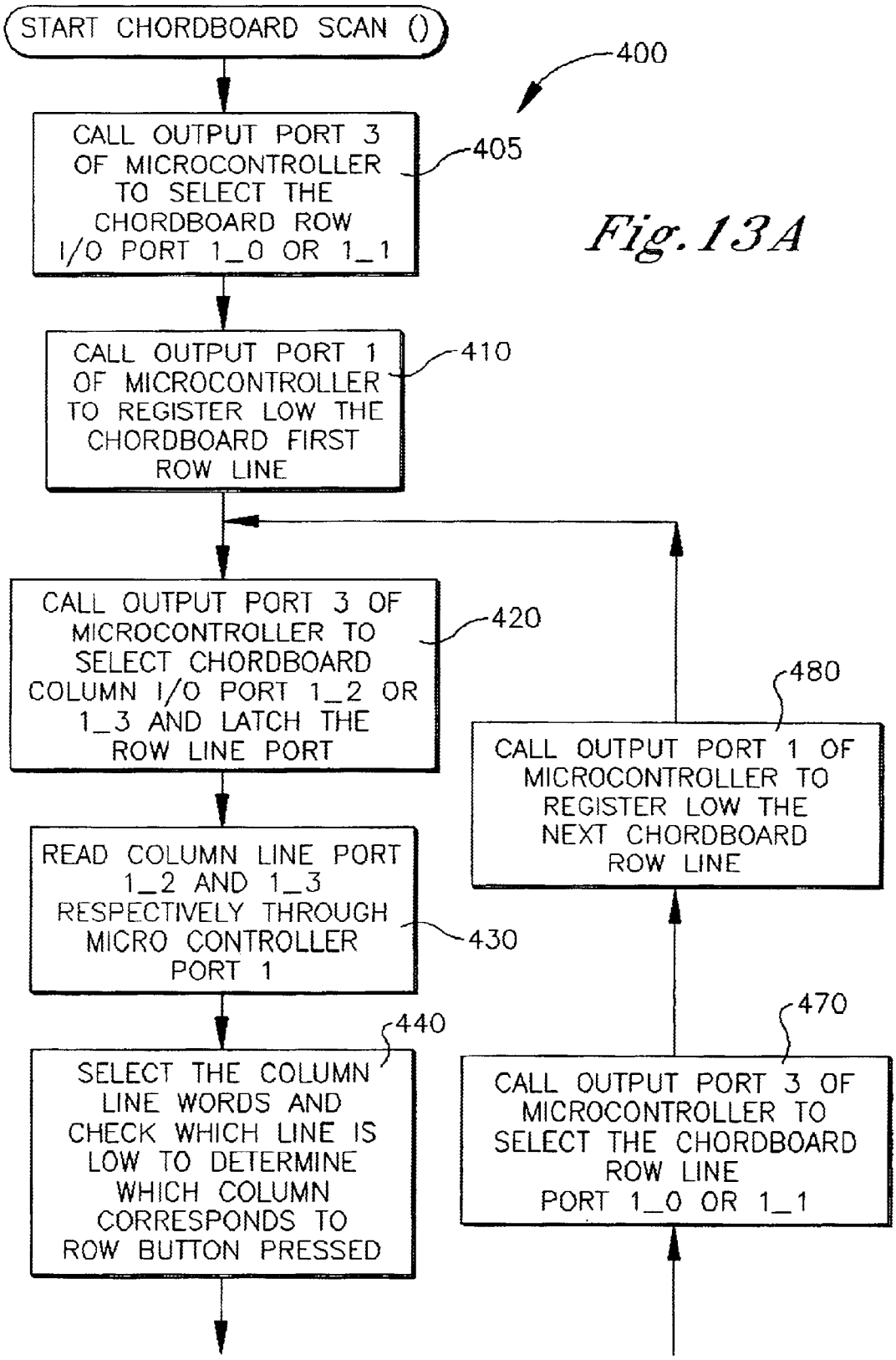
FIG. 13A is a flow chart of a chordboard scanning module for the control system, according to the present invention.

Now referring to FIG. 13A, a flow chart of a chordboard scanning module 400 for the control system 14 is shown, according to the present invention. In summary, this scanning module 400, comprising a plurality of steps, obtains the input by scanning the chordboard input matrix row lines and column lines respectively. The input is the pressing of one or more chords on the chordboard 12. More specifically, the microcontroller 210 serially selects one or more extended I/O ports 260 as each chord is manually pressed or released, then reading each row and column to register its logic state as high or low respectively.

Continuing with FIG. 13A, the chordboard scanning module 400 is an option from the system administration module 300. The "call the chordboard scanning function" step 315 described in FIG. 12A proceeds to the chordboard scanning module 400. The first step is the "call output port 3 of the microcontroller 210 to select the chordboard row I/O port 1_0 or 1_1" step 400. The logic of the microcontroller 210 decides which I/O port to select; either I/O port 1_0 260*a*, or I/O port 1_1 260*b*. The second step is the "call output port 1 of the microcontroller 210 to register low for the chordboard first row line" step 410. The third step is the "call the output port 3 of the microcontroller 210 to select the chordboard column line I/O port 1_2 or 1_3 and latch the row line port" step 420.

Figure 13B:
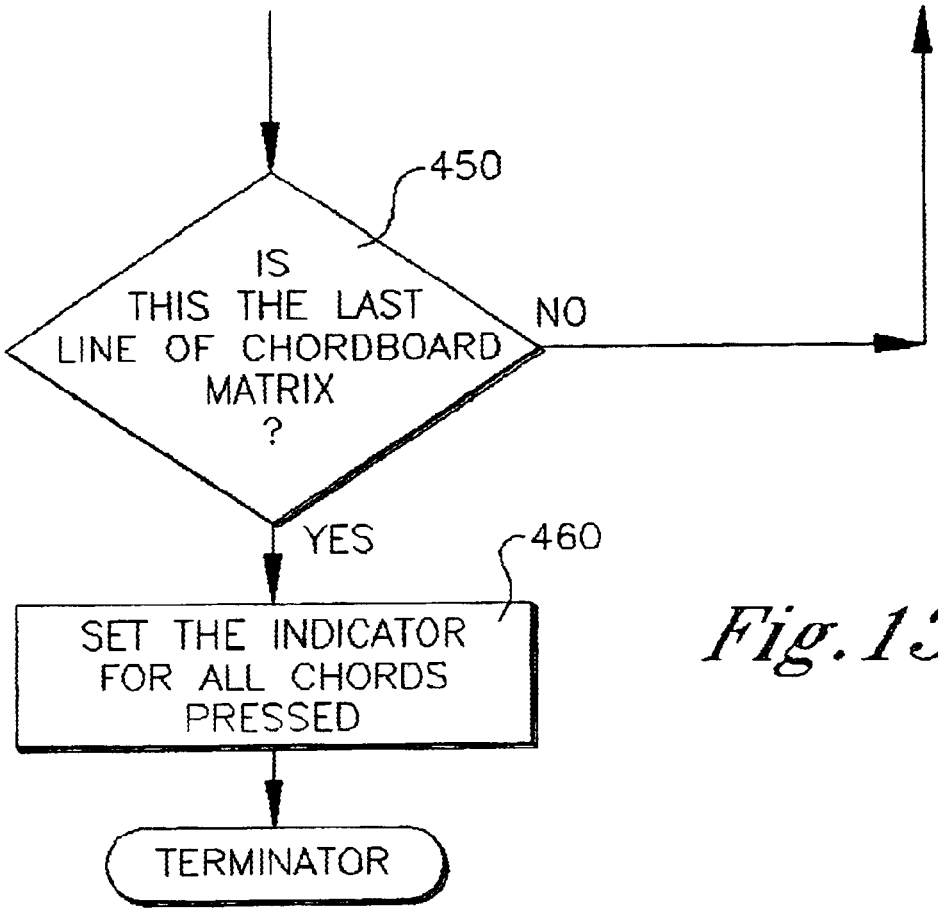
FIG. 13B is the second part of the flow chart of the chordboard scanning module for the control system, according to the present invention.

The logic of the microcontroller 210 decides which I/O port to select; either I/O port 1_2 260*c*, or I/O port 1_3 260*d*. The fourth step is for the program to "read a column line I/O port 1_2 and 1_3 respectively through the microcontroller 210 port 1" step 430. The fifth step is to "select the column line words and check which line is low to determine which column corresponds to the row chord pressed" step 440. The sixth step is shown on FIG. 13B. This sixth step is the "is this the last line of the chordboard matrix?" step 450. If the answer is "yes", then the program logic proceeds to the "set the indicator for all chords pressed" step 460. The logic terminates this function after this step. The word "terminates" is a term of art identical in meaning to "exit" or "return to main program". In other words, the program exits from that particular function and proceeds to the next step. However, if the answer is "no" to this last step, the logic proceeds to the "call output port 3 of the microcontroller 210 to select the chordboard row line I/O port 1_0 or 1_1" step 470. Refer back to FIG. 13A. Following this last step, the program proceeds to the "call output port 1 of the microcontroller 210 to register low the next chordboard row line. At this point in the program, the logic returns to the beginning of the third step 420, "call the output port 3 of the microcontroller 210 to select the chordboard column line I/O port 1_2 or 1_3 and latch the row line port" step 480.

Figure 14A:
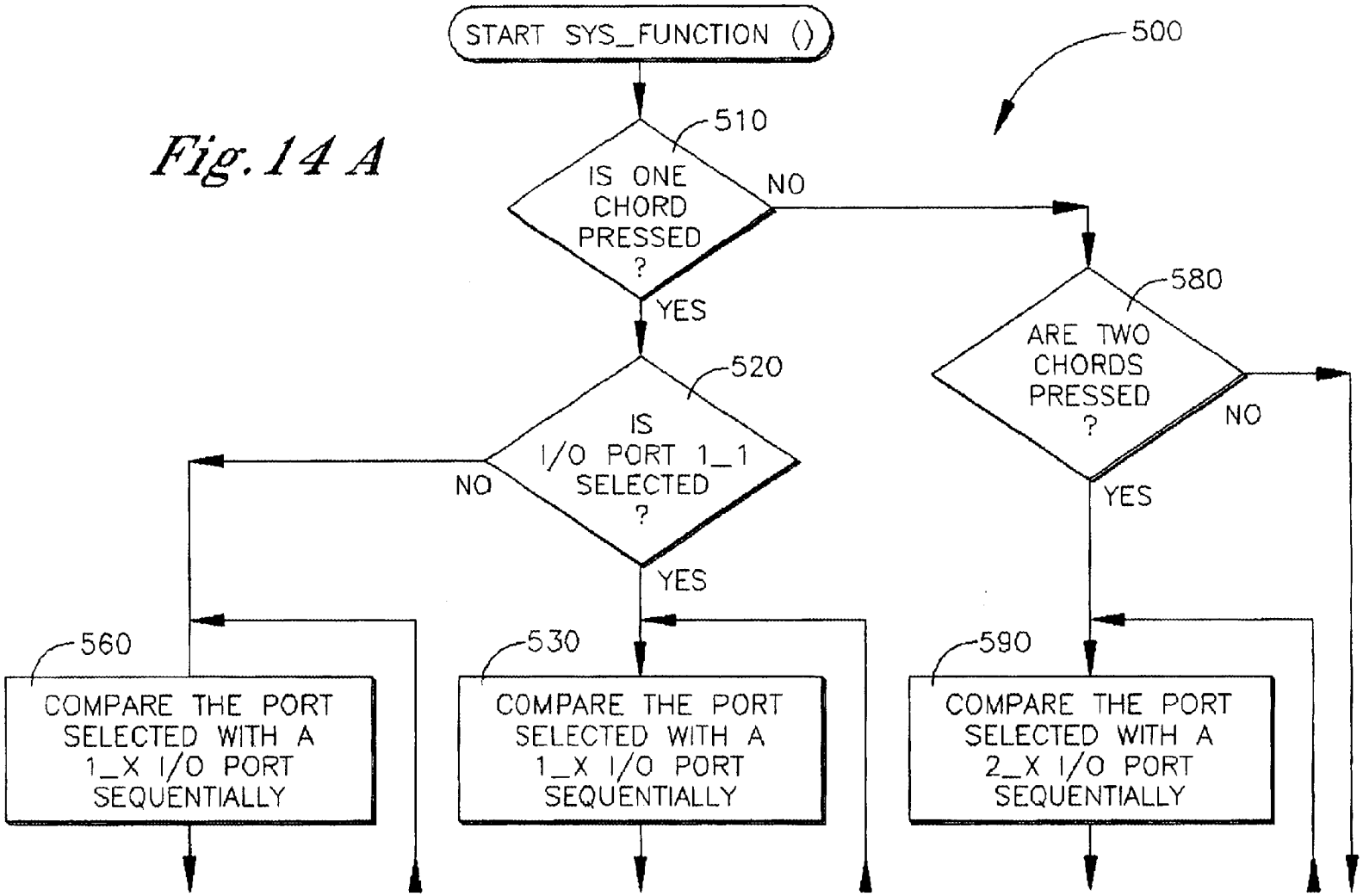
FIG. 14A is a flow chart of a system function module for the control system, according to the present invention.

Next referring to FIG. 14A, a flow chart of a system function module 500 for the control system 14 is shown, according to the present invention. This system function module 500, comprising a plurality of steps, determines the validity of each input, that is, it validates the acceptability of each chord pressed or released. Three general situations can exist. (1) If no chord is being pressed, the prior logic state is maintained. (2) If one or two chords are pressed, then the function module 500 interrogates the look-up table in the software module 250 and sends the correct output. (3) If the pressed chord does not satisfy a pre-defined function in the look-up table, the function module 500 sends an error signal to the microcontroller 210 which in turn activates the appropriate number of warning LED lights 48.

Continuing with FIG. 14A, the system function module. 500 is another option from the system administration module 300. The "is system function chord pressed?" step 345 described in FIG. 12B proceeds to the system function module 500. The first step is the "is one chord pressed?" step 510. If the answer is "yes", the program proceeds to the "is the I/O port 1_1 selected?" step 520. If the answer to this question is "yes", the program proceeds to the "compare the port selection with a 1_x I/O port sequentially" step 530.

Figure 14B:
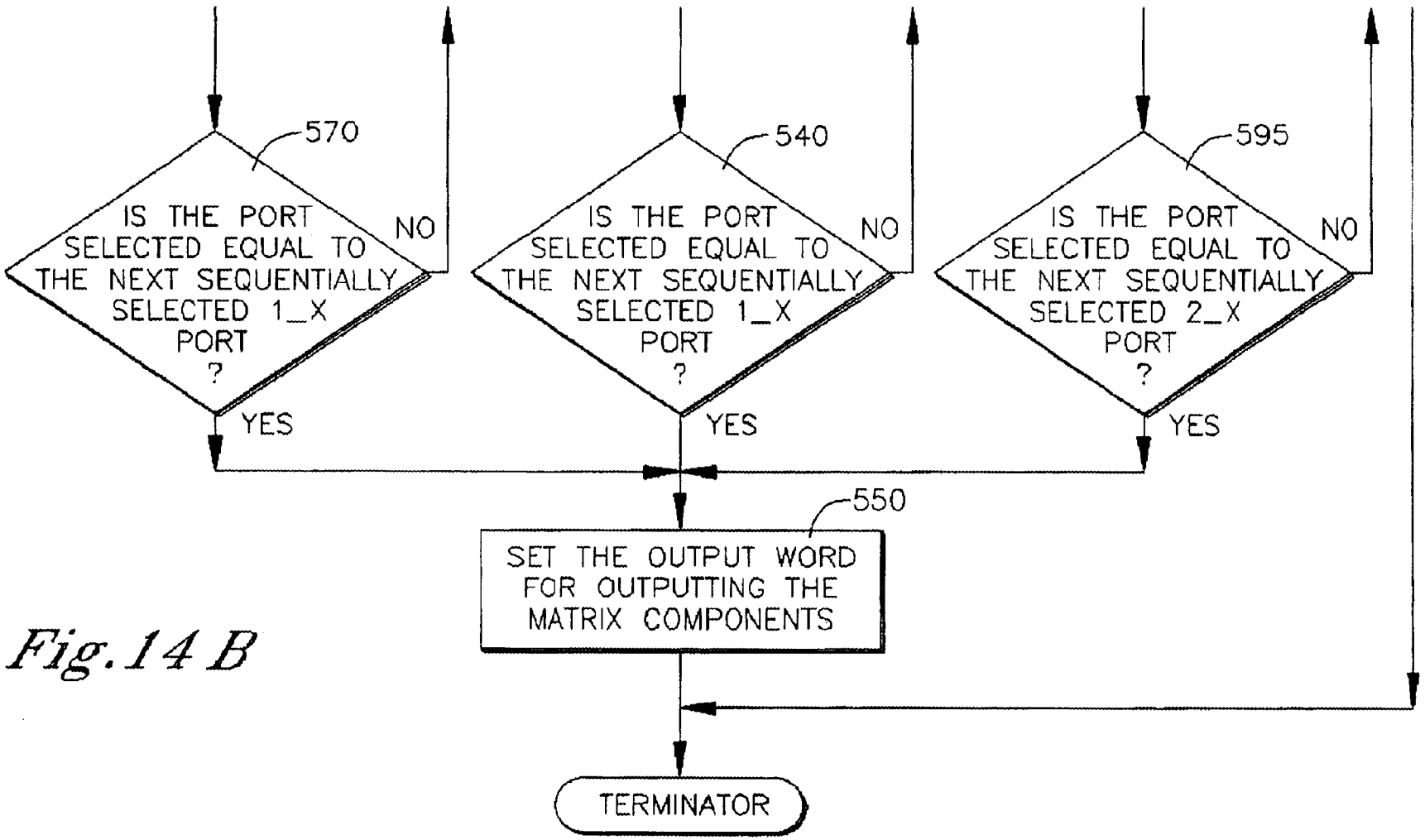
FIG. 14B is the second part of the flow chart of the system function module for the control system, according to the present invention.

The next step is shown in FIG. 14B. The next step is the "is the port selection equal to the next sequentially selected 1_x I/O port?" step 540. If the answer to this step 540 is "yes", the program proceeds to the "set the output word for outputting the matrix components" step 550. Following this step 550, the logic terminates this function. However, if the answer is "no" to the "is the port selection equal to the next sequentially selected 1_x I/O port?" step 540, then the program loops back to the output of the "is the I/O port 1_1 selected?" step 520.

If the answer is "no" to the "is the I/O port 1_1 selected?" step 520, then the program proceeds to the "compare the I/O port with a 1_x I/O port sequentially" step 560. Then the program proceeds to the "is the port selected equal to the next sequentially selected 1_x port?' step 570. If the answer to this step 570 is "yes", the program proceeds to the "set the output word for outputting the matrix components" step 550. In other words, "the matrix components" means "from the solenoids". However, if the answer is "no", to the "is the port selection equal to the next sequentially selected 1_x I/O port?" step 570, then the program loops back to the output of the "is the I/O port 1_1 selected?" step 520.

Continuing with FIG. 14A, we now return to the first step in the system function module 500, "is one key pressed?" step 510. If the answer is "no", then the logic proceeds to ask the question "are two chords pressed?" step 580. If the answer is "yes", the program proceeds to "compare the port selected with a 2_x I/O port sequentially" step 590. Then the program proceeds to the "is the port selected equal to the next sequentially selected 2_x port?" step 595. If the answer to this step 595 is "yes", the program proceeds to the "set the output word for outputting the matrix components" step 550. However, if the answer is "no", to the "is the port selection equal to the next sequentially selected 2_x I/O port?" step 595, then the program loops back to the output of the "are two keys pressed?" step 580. However, if the answer is "no", to the "are two chords pressed" step 580, then the program terminates, or exits this function.

Referring to FIG. 15, a flow chart of a self-define function module 600 for the control system 14 is shown, according to the present invention. This self-define module 600, comprising a plurality of steps, allows the user to define his own system output function. Four steps are required. First, the user presses "m" and "7". Second, the user presses any two chords from among the "m" to "D" chords, except "m" and "7". In other words, the choice is between any two chords from ma7, 6, S, A, m7, 9 and D. Refer to FIG. 4. Third, the user defines the desired output combination by pressing a combination of chords from among 1 to 150. Less than 10 chords may be pressed as the input. When the self-define module 600 receives the output combination, it records them in the software module 250 look-up table. Fourth, and finally, the user must press the "m" and "7" chords for confirmation of the desired self-defined function. Unless the user confirms, the control system 14 will abort the self-define module 600. This unique feature of the present invention allows the user to play music that never existed before for a particular instrument.

Also the programmable system 10 has a special function for the system working mode. The working mode in turn has two modes; an output keeping mode and an input keeping mode. For the output keeping mode, if any combination of the pre-defined chords are pressed one time, it will keep the same output until the next combination of the predefined key buttons is pressed. However, in the output keeping mode, if the chord is repeatedly pressed, i.e. If the same chord is detected in the consecutive detection loop, the software module 250 will not accept the command. If, however, a new chord is pressed, the software module 250 clears the previous output, and sends a new output.

For the input keeping mode, the input combination of the predefined chords is pressed to get the output. When the input chords are released, the output will then clear too. In this input keeping mode, if a chord is repeatedly pressed, i.e. the same chord is detected at the consecutive detection loop, the software sends the signal to the output. When the chords are released, the software clears the output also, just as in the output keeping mode. To select the working mode, the combination of pressing the "A" membrane and the adjacent blank membrane is used to change between the working mode and the output keeping mode.

Continuing with FIG. 15A, the self-define function module 600 is another option from the system administration module 300. The "call self-define function" step 325 described in FIG. 12B proceeds to the self-define function module 600. The first step is the "call chordboard scan" step 610. The second step is "has the self-define function chord combination been pressed?" step 620. If the answer is "yes", then the program proceeds to the "call chordboard scan" step 630. The following step is asking the question "are the chords selected among the 1–150?" step 640. If the answer is "yes", then the program logic proceeds to ask the "is the chord selected less than 10?" step 650. If the answer is "yes", then the program proceeds to the "save this chord selection for the self-define function" step 660. The program then loops back to the output of the "has the self-define function chord combination been pressed" step 620.

However, if the answer to the second step is "has the self-define function chord combination been pressed?" step 620 is "no", then the program proceeds to ask "is the loop number larger than the time out number? step 670. If the answer is "yes" then the program terminates. If the answer is "no", the program loops back to the start of the self-define module 600.

We now return to the options for the "are the chords selected among the 1–150" step 640. If the answer is "no",. Then the program proceeds to ask the "are "m" and "7" chords pressed?" step 680. If the answer is "yes", then the program exits this function. If the answer is "no", then the program proceeds to another "call chordboard scan" step 690. The next step is the "is the chord number less than 10?" step 695. If the answer is "yes", then the program loops back to the output of the "has the self-define function chord combination been pressed?" step 620. However, if the answer is "no", then the program loops back to the output of the "are the chords selected among the 1–150?" step 640.

Finally, referring to FIG. 16, a flow chart of an output module 700 for the control system 14 is shown, according to the present invention. The system administration module 300 sends the output module 700 the parameters for one of three functions: 1) the solenoid output to be initiated, 2) a warning LED to be initiated or 3) an indicator LED to be initiated. Then the output module 700 decides what data should be output to the appropriate output extended ports 260 to keep the output matrix lines connected.

The warning LED is a plurality of warning LEDs 48 that are initiated when one of three undefined conditions exist. The first (1) is when one button is pressed and does not satisfy the predefined function in the look-up table of the software module 250. Then one LED 48 is illuminated. The second (2) condition is when two chords are pressed which do not satisfy a pre-defined function. Then two LEDs 48 are illuminated. The third (3) condition is when more than two chords are pressed which do not satisfy a pre-defined function. Then three warning LEDs 48 are illuminated. The indicator light LED 52 is illuminated when three conditions are satisfied. The first (1) is when the power is on. The second (2) is when the self-defining function is initiated. The third (3) is when the output mode function is initiated. The warning LEDs 48 and the indicator LED 52 are preferably removably located on the control box 26. However, another embodiment has the warning lights and the indicator light removably located in one of the vertical sides 34 of the chordboard 12 (not shown). In either embodiment, the power is provided through the control box 26.

Continuing with FIG. 16, the output module 700 comprising a plurality of steps. The first step is "check all the output row lines word's low to determine which low row lines need an output to form the out byte" step 710. The second step is the "call the port 3 output byte to select I/O port 1_4 and send the byte to drive the corresponding row lines" step 720. The third step is the "check all the output row lines words' high byte to determine which high row lines need output to form the out byte" step 730. The fourth step is the "call the port 3 output byte to select I/O port P1_5 and latch port P1_4, then send the byte to drive the corresponding row lines" step 740. The fifth step is the "check all the output column lines words' low byte to determine which low column line need output to form the out byte" step 750. The sixth step is to "call the port 3 output byte to select the I/O port P1_6 and latch P1_5 then send the byte to drive the corresponding column lines." step 760. The seventh step is the "check all the output column lines words" high byte to determine which high column line need output to form the out byte" step 770. The final step is the "call the port 3 output byte to select the P1_7 port and latch port P1_6 then send the byte to drive the corresponding column lines." step 780. Following this last step, the program terminates or exits this function.

The present invention provides many novel improvements to the playing of stringed instruments. The Applicant thinks the present invention overcomes many long-standing and even ignored problems and disadvantages of the prior art. This new system only requires one or two fingers to play, eliminating the need to move hands and fingers along a fret board, prevents straining of hand and finger muscles, and allows any player to play any song, regardless of the size of their hands. In addition, the present invention expands the sound range of any string instrument. The present invention is also capable of pressing any chord, including chords that cannot be played with an unaided human hand. Also the present invention enables a player to strum all strings for any chord. Plus, a player can add desired chords to the system memory; and can even ad lib against a simultaneously held note. The present invention provides a novel membrane switch chordboard. A unique chord arrangement applicable to various stringed instruments is provided. Also, a novel software program greatly facilitates the playing of many stringed instruments through the use of a look-up table. Harmonies and melodies can be written and programmed for instruments that currently do not have such music because of the previous need to play with a finger technique.

Three different novel modes of operation are possible in the present invention. The first is one-to-one input & output. The second mode is one input to multiple output. The third type is the two input to multiple output. Another novel feature of the programmable system 10 is its adaptability to many other stringed instruments. For instance, measuring the dimensions of the various stringed instrument fretboards permits engineering design changes to modify the described fretboard 18 and chordboard 12. Fixed fret systems include the banjo, mandolin, and bass guitar, while those instruments without a fixed fret system include the violin, cello, and contrabass.

Consequently, while the foregoing description has described the principle and operation of the present invention in accordance with the provisions of the patent statutes, it should be understood that the invention may be practiced otherwise as illustrated and described above and that various changes in the size, shape, and materials, as well as on the details of the illustrated construction may be made, within the scope of the appended claims without departing from the spirit and scope of the invention.

Reference Numerals In Drawings

10 programmable system
12 chordboard
14 electronic control system
16 stringed instrument
18 modified fretboard
20 neck
22 sound box
24 extended metallic lip
26 control box
28 header ribbon cable
30 instrument underside
32 first cutout
34 chordboard vertical sides
36 solenoid ribbon cable
38 second cutout
40 power cord
42 on off switch
44 secondary on/off switch
46 on/off switch wire
48 warning LEDs
50 top surface
52 indicator LED
54 chordboard slotted holes

56 control board
58 board securing hole
59 corner (of board)
60 control box underside
62 row and column headers
62*a* row header
62*b* column header
64 solenoid headers
66 fretboard vertical sides.
68 fretboard attachment holes
70 spring presser rod holders
70*a* first rod holder
70*b* second rod holder
72 matching holes
72*a* plurality of holes
74 instrument strings
76 base
78 membrane switch
78*a* hinged membrane switch
80 chordboard top side
82 bend location
84 frets
86 string presser rods
86*a* string presser rod end
88 solenoids
88*a* push type solenoid
88*b* pull type solenoid
90 upper left corner
92 embossed overlays
94 first arrangement
96 fret membranes
98 left side
100 right side
102 middle part
104 top block, left side
106 bottom block, left side
108 non-major chord membrane
110 major chord membranes
112 first block
114 second block
116 third block
118 fourth block
120 fretboard housing
122 housing base
124 solenoid "T" shaped base
126 graphic overlay
128 graphic adhesive layer
130 upper membrane circuit
132 spacer layer
134 lower membrane circuit
136 rear adhesive layer
138 carbon contact
140 silver contact
142 top
144 plunger
146 solenoid wire
148 threaded end of solenoid
150 threaded pressor rod section
152 plunger hook
154 windows
156 second overlay
158 second arrangement
160 left side
162 left upper block
164 left middle block
166 left lower block
168 right side
170 middle part
172 middle upper block
174 middle lower block
176 one block
178 hinges
200 AC-DC power supply
210 microcontroller
220 chordboard matrix column driver
230 solenoid output matrix driver
240 external port selector function
250 EPROM software module
260 plurality of external I/O ports
260*a* P1_0
260*b* P1_1
260*c* P1_2
260*d* P1_3
260*e* P1_4
260*f* P1_5
260*g* P1_6
260*h* P1_7
270 chordboard matrix
300 system administration module
305 initialize the system
310 self-test the system
315 call the chordboard scan function
320 determine if "m" and "7" chords pressed?
325 call self-define function
330 determine if output keeping mode on?
335 determine if chords pressed?
340 determine if the chords different from the last chords pressed?
345 determine if the system function chord pressed?
350 call the system function and set the output matrix words
355 call in the driver to the output function
360 determine if chords pressed?
365 determine if new chords pressed?
370 call out the driver to clear the output
375 determine if wrong chords pressed?
380 set the warning output word
400 chordboard scanning module
405 call output port 3 of the microcontroller 210 to select the chordboard row I/O port 1_0 or 1_1
410 call output port 1 of the microcontroller 210 to register low for the chordboard first row line" step 410
420 call the output port 3 of the microcontroller 210 to select the chordboard column line I/O port 1_2 or 1_3 and latch the row line port
430 read a column line I/O port 1_2 and 1_3 respectively through the microcontroller 210 port 1
440 select the column line words and check which line is low to determine which column corresponds to the row chord pressed
450 determine if this last line of the chordboard matrix?
460 set the indicator for all chords pressed
470 call output port 3 of the microcontroller 210 to select the chordboard row line I/O port 1_0 or 1_1
480 select the chordboard column line I/O port 1_2 or 1_3 and latch the row line port
500 system function module
510 determine if one chord pressed?
520 determine if the I/O port 1_1 selected?
530 compare the port selection with a 1_x I/O port sequentially
540 determine if port selection equal to the next sequentially selected 1_x I/O port?
550 set output word for outputting the matrix components
560 compare the I/O port with a 1_x I/O port sequentially

570 determine if port selected equal to the next sequentially selected 1_x port?
580 determine if two chords pressed?
590 compare the port selected with a 2_x I/O port sequentially
595 determine if port selected equal to the next sequentially selected 2_x port?
600 self-define function module
610 call chordboard scan
620 has the self-define function chord combination been pressed?
630 call chordboard scan
640 determine if the chords selected among the 1–150?
650 determine if the chord selected less than 10?
660 save this chord selection for the self-define function
670 determine if the loop number larger than the time out number?
680 determine if "m" and "7" chords pressed?
690 call chordboard scan
695 determine if chord number less than 10?
700 output module
710 check all the output row lines word's low to determine which low row lines need an output to form the out byte
720 call the port 3 output byte to select I/O port 1_4 and send the byte to drive the corresponding row lines
730 check all the output row lines words' high byte to determine which high row lines need output to form the out byte
740 call the port 3 output byte to select I/O port P1_5 and latch port P1_4, then send the byte to drive the corresponding row lines
750 check all the output column lines words' low byte to determine which low column line needs output to form the out byte
760 call the port 3 output byte to select the I/O port P1_6 and latch P1_5 then send the byte to drive the corresponding column lines
770 check all the output column lines words' high byte to determine which high column line needs output to form the out byte
780 call the port 3 output byte to select the P1_7 port and latch port P1_6 then send the byte to drive the corresponding column lines.

What is claimed is:

1. A method of operation for an electronically programmable system comprising:

providing AC power to said programmable system;

turning on an on/off switch; alternatively, from a chordboard or from a control box;

providing a plurality of arrangements of chords for easy reaching with a player's fingers, thereby facilitating playing said chords;

touching one membrane for a major chord or a half-tone;

touching, alternatively, two membranes for a non-major chord;

means for activating one or more membrane switches;

means for selecting solenoid drivers through a microcontroller;

means for retrieving programmed notes or chords from a software module's look-up table, within said control box;

means for energizing solenoids through said solenoid drivers;

means for activating plungers in said solenoids;

means for pressing strings in said system by said plungers strumming, or alternatively, picking said strings; thereby producing sound through a sound box of a stringed instrument;

lifting one's finger or fingers from said membranes;

means for deactivating one or more of said plungers, thereby stopping sound when said plungers no longer contact said strings; and repeating said touching one membranes for a major chord or a half-tone step; or, alternatively, repeating said touching repeating said touching two membranes step.

2. A system for playing stringed instruments comprising:

means for inputting chords and notes into said system;

means for controlling said system;

means for electronically programming chords and notes for a plurality of stringed instruments; and means for outputting sound from said system, wherein said means for inputting chords and notes into said system comprise a chordboard; and further wherein said means for controlling said system comprise an electronic control system; and further wherein said control system comprises means for electronically programming chords and notes for a plurality of stringed instruments, wherein said means for electronically programming chords and notes comprises an EPROM software module further comprising a look-up table; and further wherein said means for outputting sound from said system comprises a stringed instrument, and further wherein said stringed instrument is a modified six string guitar.

3. An electronic programmable system for playing stringed instruments according to claim 1, wherein said stringed instrument is a modified guitar with at least 10 strings, whereby the sound range of said modified guitar is a full six octaves.

4. An electronic programmable system for playing stringed instruments according to claim 1, wherein said stringed instrument is a fixed fret instrument, and further wherein said fixed fret instrument has a modified fret board to accommodate said chordboard.

5. An electronic programmable system for playing stringed instruments according to claim 1, wherein said instrument has an un-fixed fret system, and further wherein said instrument is one of the group comprising at least a violin, a cello, and a contrabass.

6. An electronic programmable system for playing stringed instruments according to claim 1, wherein said stringed instrument comprises a modified fretboard, a neck and a sound box, and further wherein said chordboard is securely affixed to said modified fretboard.

7. An electronic programmable system for playing stringed instruments according to claim 1, wherein said chordboard extends longitudinally between said neck and said sound box.

8. An electronic programmable system for playing stringed instruments according to claim 1, wherein said chordboard extends part way from said neck toward said sound box.

9. An electronic programmable system for playing stringed instruments according to claim 1, wherein said chordboard is secured over said modified fretboard.

10. An electronic programmable system for playing stringed instruments according to claim 1, wherein said chordboard is secured underneath said stringed instrument extending from said neck to said sound box.

11. An electronic programmable system for playing stringed instruments according to claim 1, wherein said control system further comprises an EPROM software module to store programs which manage said entire programmable system and execute all functions, and further wherein said software module comprises a look-up table, said table including harmonies and melodies for a plurality of said stringed instruments.

12. An electronic programmable system for playing stringed instruments according to claim 1, wherein said control system provides chordboard management, system function control and output management.

13. An electronic programmable system for playing stringed instruments according to claim 1, wherein said chordboard further comprises an embossed overlay securely affixed onto a membrane switch, and further wherein said embossed overlay comprises a first arrangement of chords and notes in one embodiment, and further wherein said first arrangement comprises three types of chords and notes, said types classified by function of non-major chords, major open chords, and matrix elements.

14. An electronic programmable system for playing stringed instruments according to claim 1, wherein said chordboard further comprises an embossed overlay, and further wherein said embossed overlay comprises a second arrangement of chords and notes in another embodiment, and further wherein said second arrangement comprises three types of chords and notes, said types classified by function of non-major chords, major open chords, and matrix elements.

15. An electronic programmable system for playing stringed instruments according to claim 1, wherein said modified six string guitar is an acoustic guitar.

16. An electronic programmable system for playing stringed instruments according to claim 1, wherein said modified six string guitar is an electric guitar.

17. An electronic programmable system for playing stringed instruments according to claim 4, wherein said fixed fret instrument is one of the group comprising at least a banjo, a mandolin, and a bass guitar.

18. An electronic programmable system for playing stringed instruments according to claims 6, wherein said modified fretboard comprises a plurality of rod end holders and rod center holders, each of said holders approximately evenly spaced along said modified fretboard, and further wherein said holders are fixedly secured into opposing sides of said modified fretboard, and wherein said holders movably secure a plurality of string presser rods with a plurality of push solenoids removably secured in each of said string pressor rods, wherein each of said push solenoids further comprises a plunger movably secured within each of said solenoids, and further wherein said plunger preferably comprises a "T"-shaped base, whereby said base presses a desired string when thrust in a downward direction.

19. An electronic programmable system for playing stringed instruments according to claim 6, wherein said solenoid is a pull solenoid, and further wherein said plunger comprises a hook, whereby said hook, when activated, moves downwardly to pull down said string.

20. An electronic programmable system for playing stringed instruments comprising:

a chordboard;

a stringed instrument to which said chordboard is securely affixed; and an electronic control system securely affixed to said stringed instrument and electrically connected to said chordboard.

21. An electronic programmable system for playing stringed instruments according to claim 20, wherein said stringed instrument is a modified six string guitar.

22. An electronic programmable system for playing stringed instruments according to claim 20, wherein said stringed instrument is a fixed fret instrument, and further wherein said fixed fret instrument has a modified fret board to accommodate said chordboard, and further wherein said fixed fret instrument is one of the group comprising at least a banjo, a mandolin, and a bass guitar.

23. An electronic programmable system for playing stringed instruments according to claim 20, wherein said instrument has an un-fixed fret system, and further wherein said instrument is one of the group comprising at least a violin, a cello, and a contrabass.

24. An electronic programmable system for playing stringed instruments according to claim 20, wherein said stringed instrument comprises a modified fretboard, a neck and a sound box, and further wherein said chordboard is securely affixed to said modified fretboard.

25. An electronic programmable system for playing stringed instruments according to claim 20, wherein said chordboard extends longitudinally between said neck and said sound box.

26. An electronic programmable system for playing stringed instruments according to claim 20, wherein said chordboard extends part way from said neck toward said sound box.

27. An electronic programmable system for playing stringed instruments according to claim 20, wherein said chordboard is secured over said modified fretboard.

28. An electronic programmable system for playing stringed instruments according to claim 20, wherein said chordboard is secured underneath said stringed instrument extending from said neck to said sound box.

29. An electronic programmable system for playing stringed instruments according to claim 20, wherein said control system further comprises an EPROM software module to store programs which manage said entire programmable system and execute all functions, and further wherein said software module comprises a look-up table.

30. An electronic programmable system for playing stringed instruments according to claim 20, wherein said control system provides chordboard management, system function control and output management.

31. An electronic programmable system for playing stringed instruments according to claim 20, wherein said chordboard further comprises an embossed overlay securely affixed onto a membrane switch, and further wherein said first embossed overlay comprises a first arrangement of chords and notes in one embodiment, and further wherein said first arrangement comprises three types of chords and notes, said types classified by function of non-major chords, major open chords, and matrix elements.

32. An electronic programmable system for playing stringed instruments according to claim 20, wherein said chordboard further comprises an embossed overlay, and further wherein said embossed overlay comprises a second arrangement of chords and notes in another embodiment, and further wherein said second arrangement comprises three types of chords and notes, said types classified by function of non-major chords, major open chords, and matrix elements.

33. An electronic programmable system for playing stringed instruments according to claim 21, wherein said stringed instrument is a modified guitar with greater than six strings.

34. An electronic programmable system for playing stringed instruments according to claim 21, wherein said modified six string guitar is an acoustic guitar.

35. An electronic programmable system for playing stringed instruments according to claim 21, wherein said modified six string guitar is an electric guitar.

36. An electronic programmable system for playing stringed instruments according to claim 31, wherein said non-major chords comprise m, 7, ma7, m7, 6, 9, s, D and A; wherein said "Ma" represents "major", and wherein said "m" represents "minor"; and further wherein said major open chords comprise B, E, A, D, C, F, Bb, Eb, Ab, Db, and Gb, wherein said "b" represents a "flat", and further wherein said major chords comprise F, G, A, B, C, D, E, Gb, Ab, Bb, Db, and Eb; and further wherein said matrix elements comprise individual unlettered membranes.

37. An electronic programmable system for playing stringed instruments according to claim 31, wherein said first arrangement further comprises a left side of said overlay displaying open chords and scales, a middle part of said overlay exhibiting said matrix elements for each half tone of each string, and a right side, and further wherein said left side further comprises a top block and a bottom block, wherein said top block comprises abbreviations of said non-major chords comprising m, 7, ma7, m7, 6, 9, S, D, and A, wherein said abbreviation "m" stands for minor; "7", dominant 7th; "ma7", major 7th; "m7", minor 7th; "6", 6th; "9", 9th; "S", suspended, "D", diminished;,and "A", augmented; and further wherein said bottom block contains twelve major chords comprising B, E, A, D, G, C Bb, Eb, Ab, Db, Gb, F, wherein said abbreviation "B" stands for B major; "E", E major; "A", A major; "D", D major; "G", G major; "C", C major; "Bb", B major; "Eb", Eb major; "Ab", Ab major; "Db", Db major; "Gb", Gb major; and "F", F major; and further wherein said right side comprises four blocks, wherein a right side top block comprises abbreviations of said non-major chords comprising m, 7, ma7, m7, 6, 9, S, D, and A; and wherein a second block comprises twelve major root 6 bar chords; and wherein a third block comprises twelve major root 5 bar chords; and wherein a fourth block comprises twelve major root 2 bar chords.

38. An electronic programmable system for playing stringed instruments according to claim 32, wherein said second arrangement comprises a left side, a middle side, and a right side, and further wherein said left side displays the names of the open chords and scales in a first block, a second block, and a third block; and further wherein said first block contains the abbreviations of several of the major open chords, including F, G, A, Gb, and Ab.; and further wherein said second block contains the abbreviations for the major open chords: F, G, A, B, C, D, E, Gb, Ab, Bb, Db, and Eb; and further wherein said third block repeats said second block; and further wherein said middle part of said second arrangement has a middle upper block and a middle lower block, wherein said middle upper block displays the major open chords Bm, Em, Am, Dm, Gm, Cm, B, E, A, D, G, C, B7, E7, A7, D7, G7, and C7, and further wherein said middle lower block displays the major open chords Bbm, Ebm, Abm, Dbm, Gbm, Fm, Bb, Eb, Ab, Db, Gb, F, Bb7, Eb7, Ab7, Db7, Gb7, and F7; and further wherein said right side of said second arrangement displays the names of the non-major chords in one block; maj, 6, S, A, m, 9, and D, thereby providing an easy way for a player to play simpler songs using only major open chords, thereby also allowing easy movement from one major chord to another using either one finger or two fingers because of the placement and duplication of the chords on said second arrangement.

39. An electronic programmable system for playing stringed instruments according to claim 32, wherein said second arrangement comprises a left side, a middle side, and a right side, and further wherein said left side displays the names of the open chords and scales in a first block, a second block, and a third block; and further wherein said first block contains the abbreviations of several of the major open chords, including F. G, A, Gb, and Ab.; and further wherein said second block contains the abbreviations for the major open chords: F, G, A, B, C, D, E, Gb, Ab, Bb, Db, and Eb; and further wherein said third block repeats said second block; and further wherein said middle part of said second arrangement has a middle upper block and a middle lower block, wherein said middle upper block displays the major open chords Bm, Em, Am, Dm, Gm, Cm, B, E, A, D, G, C, B7, E7, A7, D7, G7, and C7, and further wherein said middle lower block displays the major open chords Bbm, Ebm, Abm, Dbm, Gbm, Fm, Bb, Eb, Ab, Db, Gb, F, Bb7, Eb7, Ab7, Db7, Gb7, and F7; and further wherein said right side of said second arrangement displays the names of the non-major chords in one block; maj, 6, S, A, m, 9, and D, thereby providing an easy way for a player to play simpler songs using only major open chords, thereby also allowing easy movement from one chord to another using either one finger or two fingers because of the placement and duplication of the chords on said second arrangement.

40. A method of operation for an electronically programmable system comprising the steps of:

providing AC power to said programmable system;

turning on an on/off switch; alternatively, from a chordboard or from a control box;

providing a plurality of arrangements of chords for easy reaching with a player's fingers, thereby facilitating playing said chords;

touching one membrane for a major chord or a half-tone;

touching, alternatively, two membranes for a non-major chord;

activating one or more membrane switches;

selecting solenoid drivers through a microcontroller;

retrieving programmed notes or chords from a software module's look-up table, within said control box;

energizing solenoids through said solenoid drivers;

activating plungers in said solenoids;

pressing strings in said system by said plungers;

strumming, or alternatively, picking said strings; thereby producing sound through a sound box of a stringed instrument;

lifting one's finger or fingers from said membrane;

deactivating one or more of said plungers, thereby stopping sound when said plungers no longer contact said strings; and repeating said touching one membrane for a major chord or a half-tone step; or, alternatively, repeating said touching two membranes step.

41. A method of operation for an electronically programmable system according to claim 40, wherein said method further comprises three different novel modes of operation, and further wherein said modes comprise one-to-one input and output, one input to multiple output, and two input to multiple output.

42. A method of operation for an electronically programmable system, according to claim 40, whereby the duration of the touch in said touching one overlay membrane step for a major chord or a half-tone, equals the beat of the music; whereby the duration of the touch in said touching alternatively, two overlay membranes step for a non-major chord, equals the beat of the music; wherein said method further comprises the steps of:

touching, alternatively, at least one of a plurality of fret membranes in a middle part of said chordboard, wherein each of said fret membranes corresponds to a note on a scale;

touching, alternatively, an open chord on a left side of said chordboard, then a bar chord on a right side of said chordboard, whereby a player may easily move his fingers from one side to the other of said chordboard, wherein an arrangement of chords comprises the names of the flat chords located below the names of the corresponding natural major chord, thereby making playing easy and convenient;

touching, alternatively, one chord with one finger, then touching a plurality of overlay membranes in succession with another finger, thereby allowing a player to ad lib against virtually any chord;

activating one or more membrane switches;

retrieving programmed notes or chords from a software module's look-up table, within said control box, including the root 2 bar comprising all nine non-major types of chords, thereby allowing a player to play the root 2 bar, whereas, heretofore, a player could not play the root 2 bar because of awkward fingerings;

pressing strings in said system by said plungers;

strumming, or alternatively, picking said strings; thereby producing sound through a sound box of a stringed instrument;

lifting one's finger or fingers from said overlay membrane;

deactivating one or more of said plungers, thereby stopping sound when said plungers no longer contact said strings; and repeating said touching one overlay membrane for a major chord or a half-tone step; or, alternatively, repeating said touching two overlay membranes step.

43. An electronic programmable system for playing stringed instruments according to claims 41, wherein said non-major chords comprise m, 7, ma7, m7, 6, 9, s, D and A; wherein said "Ma" represents "major", and wherein said "m" represents "minor"; and further wherein said major open chords comprise B, E, A, D, C, F, Bb, Eb, Ab, Db, and Gb, wherein said "b" represents a "flat", and further wherein said major chords comprise F, G, A, B, C, D, E, Gb, Ab, Bb, Db, and Eb; and further wherein said matrix elements comprise individual unlettered membranes.

44. An electronic programmable system for playing stringed instruments according to claim 18, wherein said first arrangement further comprises a left side of said overlay displaying open chords and scales, a middle part of said overlay exhibiting said matrix elements for each half tone of each string, and a right side, and further wherein said left side further comprises a top block and a bottom block, wherein said top block comprises abbreviations of said non-major chords comprising m, 7, ma7, m7, 6, 9, S, D, and A, wherein said abbreviation "m" stands for minor; "7", dominant 7th; "ma7", major 7th; "m7", minor 7th; "6", 6th; "9", 9th; "S", suspended, "D", diminished;,and "A", augmented; and further wherein said bottom block contains twelve major chords comprising B, E, A, D, G, C Bb, Eb, Ab, Db, Gb, F, wherein said abbreviation "B" stands for B major; "E", E major; "A", A major; "D", D major; "G", G major; "C", C major; "Bb", B major; "Eb", Eb major; "Ab", Ab major; "Db", Db major; "Gb", Gb major; and "F", F major; and further wherein said right side comprises four blocks, wherein a right side top block comprises abbreviations of said non-major chords comprising m, 7, ma7, m7, 6, 9, S, D, and A; and wherein a second block comprises twelve major root 6 bar chords; and wherein a third block comprises twelve major root 5 bar chords; and wherein a fourth block comprises twelve major root 2 bar chords.

* * * * *